United States Patent [19]

Funk

[11] Patent Number: 4,494,959

[45] **Date of Patent: * Jan. 22, 1985**

[54] COAL-WATER SLURRY AND METHOD FOR ITS PREPARATION

[75] Inventor: James E. Funk, Alfred Station, N.Y.

[73] Assignee: Alfred University Research Foundation, Inc., Alfred, N.Y.

[ * ] Notice: The portion of the term of this patent subsequent to Nov. 22, 2000 has been disclaimed.

[21] Appl. No.: 509,713

[22] Filed: Jun. 30, 1983

Related U.S. Application Data

[63] Continuation of Ser. No. 288,737, Jul. 31, 1981, Pat. No. 4,416,666, which is a continuation-in-part of Ser. No. 088,815, Oct. 26, 1979, Pat. No. 4,282,006, which is a continuation-in-part of Ser. No. 975,166, Nov. 2, 1978, abandoned, which is a continuation-in-part of Ser. No. 790,337, Apr. 25, 1977, abandoned.

[51] Int. Cl.[3] ..... C10L 1/32

[52] U.S. Cl. ..... 44/51; 406/197

[58] Field of Search ..... 44/51; 406/197

[56] References Cited

U.S. PATENT DOCUMENTS

| | | | |
|---|---|---|---|
| 4,104,035 | 8/1978 | Cole et al. | 44/51 |
| 4,201,552 | 5/1980 | Rowell et al. | 44/51 |
| 4,261,701 | 4/1981 | Schulz et al. | 44/51 |
| 4,416,666 | 11/1983 | Funk | 44/51 |

*Primary Examiner*—Jacqueline V. Howard

*Attorney, Agent, or Firm*—Howard J. Greenwald

[57] ABSTRACT

A deashed coal-water slurry and process for preparing the same containing 65–85 percent of solids and 0.01–2.4 weight percent of dispersing agent. The slurry is comprised of a coal compact whose coal particles have a particle size distribution in substantial accordance with a specified formula. The coal-water slurry has a relatively low viscosity of less than 4,000 centipoise at a 75 percent solids content and, when it is pumped at either a constant or an increasing shear rate, its viscosity decreases. Also disclosed are a pumping process and an electrophoretic deashing cell and process.

15 Claims, 16 Drawing Figures

COAL-WATER SLURRY AND METHOD FOR ITS PREPARATION

CROSS REFERENCES TO RELATED APPLICATIONS

This application is a continuation of applicants copending application Ser. No. 288,737 filed July 31 1981 now U.S. Pat. No. 4416,666 which in turn was a continuation-in-part of applicant's copending application Ser. No. 088,815 filed on Oct. 26, 1979, now U.S. Pat. No. 4282006 which was a continuation-in-part of copending application Ser. No. 957,166 filed on Nov. 2, 1978 and now abandoned, which in turn was a continuation-in-part of copending application Ser. No. 790,337 filed on Apr. 25, 1977 and also now abandoned.

TECHNICAL FIELD

This application relates to a deashed coal-water slurry and processes for preparing and pumping it, which slurry contains from about 65 to about 85 weight percent of solids, from about 15 to about 35 percent of water, and from about 0.01 to about 4.0 percent of dispersing agent. The slurry is comprised of a coal compact whose particle size distribution is in accordance with a specific formula.

BACKGROUND

Coal-water slurries are well known to those skilled in the art. Some of them have a high solids content and can be burned directly without being dewatered. Some of them have a low viscosity and can be readily pumped through pipelines. Some of them are stable and can be stored for long periods of time in a quiescent state before being burned.

There are no prior art coal water slurries known to applicant which combine the properties of high solids content, low viscosity, and stability. The prior art teaches that high density coal-water slurries have high viscosities and are substantially unpumpable. Thus, as is taught in U.S. Pat. No. 4,104,035 of Cole et al., "As the solids content increases above this range the slurry becomes increasingly difficult to pump and at about 50% solids content it is unpumpable" (lines 30–33 of Column 1).

It would be advantageous for a coal-water slurry to possess the properties of stability, low viscosity, and a high solids content. Furthermore, the viscosity of this slurry should decrease at a constant shear rate; a slurry which possessed this property would become easier to pump as it was travelling through a pipeline of substantially constant diameter. Furthermore, the viscosity of this slurry should decrease at increasing shear rate; a slurry which possessed this property would, as, e.g., the diameter of the pipeline decreased, become easier to pump. Furthermore, because it is desirable to heat a coal-water slurry while it is being pumped to a furnace in order to facilitate its atomization, this slurry should have a negative temperature coefficient of viscosity.

It is an object of this invention to provide a deashed coal-water slurry which has a high solids content, has low viscosity, is stable, has a viscosity which decreases at a constant shear rate, at an increasing shear rate, or with increasing temperature, is cleaner and less viscous than comparable prior art coal-water slurries and which can be prepared without creating a substantial amount of waste fines. It is another object of this invention to provide a process for grinding such a slurry, for pumping such a slurry, and for cleaning a coal-water mixture to produce such a deashed slurry.

BRIEF SUMMARY OF THE INVENTION

In accordance with this invention, there is provided a stable deashed coal-water slurry containing from about 65 to about 85 weight percent of solids, from about 15 to about 35 weight percent of carrier water, and from about 0.01 to about 4.0 weight percent, based on dry weight of coal, of dispersing agent, and from about 0 to about 14 weight percent of ash, wherein:

1. said coal-water slurry has a Brookfield viscosity of less than 4,000 centipoise when tested at a solids content of 75 weight percent, ambient temperature, and 60 revolutions per minute;
2. said coal-water slurry has a yield stress of from about 0.1 to about 10 Pascals;
3. the viscosity of said coal-water slurry decreases at a constant shear rate with time, decreases at an increasing shear rate, and decreases at an increasing temperature;
4. said coal-water slurry comprises a compact of finely-divided particles of coal dispersed in said carrier water;
5. at least about 85 weight percent of the particles of coal in said coal-water slurry have a particle size less than 300 microns;
6. no more than 0.5 weight percent of the particles of coal in said slurry have a particle size less than 0.05 microns;
7. from about 5 to about 36 weight percent of the particles of coal in said slurry are of colloidal size, being smaller than about 3 microns, and said colloidal sized particles of coal have a net zeta potential in said coal-water slurry of from about 15 to about 85 millivolts;
8. said compact of finely divided particles of coal has a particle size distribution substantially in accordance with the following formula:

$$CPFT = \frac{D^n - D_S^n}{D_L^n - D_S^n} \cdot 100,$$

where

CPFT = cumulative weight percent, dry basis, of particles finer than a particle of stated size, D, D = diameter of any particle in the compact, $D_L$ = diameter of largest particle in compact, sieve size or its equivalent, being from about 38 to about 400 microns, $D_S$ = diameter of smallest particle in compact, being from about 0.01 to about 0.4 microns, and n = numerical exponent, with n being from about 0.2 to about 0.5 and with all diameters sized in microns.

BRIEF DESCRIPTION OF THE DRAWINGS

The present invention will be more fully understood by reference to the following detailed description thereof, when read in conjunction with the attached drawings, wherein like reference numerals refer to like elements and wherein;

Referring to FIG. 1, A is a viscosity curve derived from a coal-water slurry having a consist according to blend A of FIG. 11; FIG. 1, B is a viscosity curve derived from a coal-water slurry having a consist according to blend B of FIG. 11; D is viscosity curve derived from a coal-water slurry having a consist according to blend C of FIG. 11; FIG. 1, C is a viscosity curve derived from a coal-water slurry having a consist according to the formula milled W. Virginia coal of FIG. 12.

FIG. 2 is based on the data shown in FIG. 13. Negative slope in FIG. 13 indicates yield pseudoplasticity and the lowest 30 rpm viscosity with yield pseudoplasticity indicates an optimum amount of dispersing agent to use to obtain an optimum slurry. Zeta potential measurements can be made at each addition and correlated to the wgt. % of dispersing agent at each reading as shown in the inset.

DETAILED DESCRIPTION OF THE INVENTION

Figure 1:
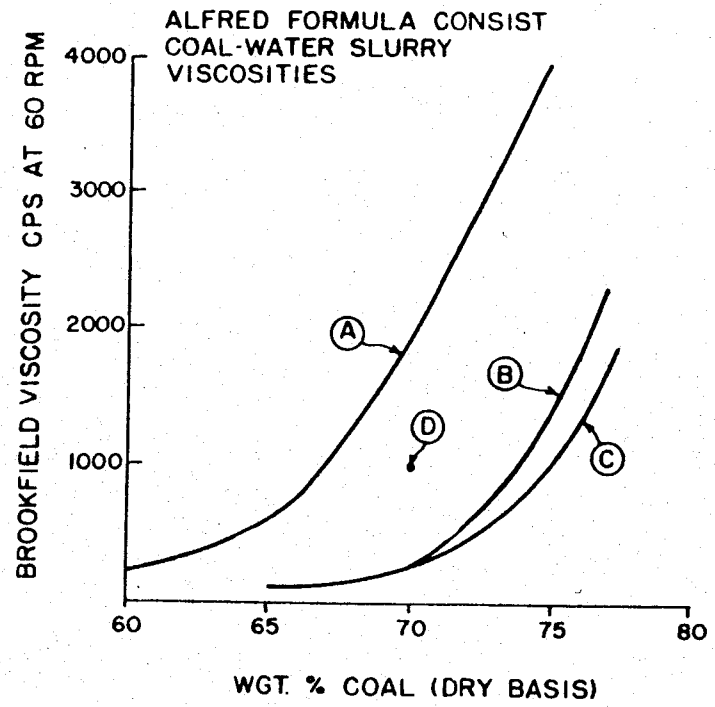
FIG. 1 is a chart showing correlations between Brookfield viscositites in centipoises (cps) at 60 rpm and wgt. % of coal, dry basis, content of several coal-water slurries.

It is preferred that, in the deashed slurry of this invention, the coal consist be about 400 microns by about 0.01 microns. As used herein, the term "consist" means the particle size distribution of at least 85 weight percent of the solid phase of the coal-water slurry, and it indicates the range of particle sizes which comprise said 85 weight percent of said solid phase; particle sizes which do not represent at least 0.5 weight percent of said solid phase are not reflected in the "consist" definition. The term "about 400 microns×0.05 microns" includes a coal consist wherein less than 0.5 weight percent of the particles of coal have a size less than 0.05 microns, and at least 85 weight percent of the particles of coal have a particle size ranging from 0.05 microns to 400 microns.

As used in this specification, the term "$D_S$" represents the diameter of the smallest particle in the consist (as measured by a scanning electron microscope or equivalent means), and the term "$D_L$" represents the diameter of the largest particle in the consist (sieve size or its equivalent). In the 400 micron×0.05 micron consist, for example, $D_S$ is 0.05 microns and $D_L$ is 400 microns.

It is preferred that $D_S$ be from about 0.05 to about 0.4 microns and, more preferably, be from about 0.05 to about 0.25 microns. In the most preferred embodiment, $D_S$ is from about 0.05 to about 0.20 microns.

As used in this specification, $D_L$ is the diameter of the largest particle in the compact, sieve size or its equivalent. $D_L$ is the theorectical size modulus of the particle size distribution; when CPFT is plotted against size, the $D_L$ value is indicated as te intercept on the upper X axis of the CPFT/D plot. However, as is known to those skilled in the art, because of aberrations in grinding the coarse end of a particle size distribution, the actual top particle size is always larger than the $D_L$ obtained by, e.g., the particle size equation described in this case; thus, e.g., a $D_L$ size modulus of 220 microns will produce a particle distribution with at least about 98 percent of the particles smaller than 300 microns. Consequently, the coal-water slurry of this invention has a coal compact with a particle size distribution which is substantially in accordance with the CPFT equation; minor deviations caused by the actual top size being greater than the $D_L$ are within the scope and spirit of this invention.

In the coal consist of the slurry of this invention, the $D_L$ of the consist is from about 38 to about 400 microns. It is preferred that the $D_L$ be from about 100 to about 300 microns. In an even more preferred embodiment, the $D_L$ is from about 200 to about 250 microns.

In one preferred embodiment, $D_L$ is about 220 microns and at least about 98 percent of the coal particles in the consist are smaller than 300 microns.

In one preferred embodiment, the coal utilized in the coal-water slurry of this invention is "pulverized". The term "pulverized coal" (or "P.C."), as used in this specification, refers to coal which has been milled or ground to a consist of about 40 mesh × 0; see the Handbook of Chemistry and Physics, 51st Edition (CRC Publishing Co., Cleveland, Ohio, 1970–1971), page F-199, the disclosure of which is hereby incorporated herein by reference.

In view of the manner in which coal fractures during milling, coal particles will have irregular shapes which, however, are of a body (or maximum side-to-side thickness) such that the sub-sieve sized discrete particles will pass through a specified mesh of a sieve. The size of the discrete particle can be expressed in terms of a spherical diameter which, as used herein, is defined as a U.S. sieve size of from 16 mesh to 400 mesh (38 μm) or its equivalent in microns through which a coal particle from a sample of coal or coal-water slurry will pass. For particles finer than 200 mesh, the size of the particles can be expressed in μm as determined by means of a sieve, or a sedimentometer, or a scanning electron microscope (SEM). Accordingly, both sieve size and SEM sizes or their equivalents, however determined, are used in describing the invention.

Means for crushing, milling, including ball milling and roller milling, disc grinding, screening, recycling, dry (air) and wet (water) separating, and blending or otherwise combining coal fractions to obtain a compact of a desired particle size and consist are well known, as may be ascertained from the prior art.

The particle sizes of coal particles can be measured by means well known to those skilled in the art. The following three methods for measuring coal particle sizes are preferred:

1. For particles of at least 75 microns diameter and greater, U.S. Series sieves numbers 16, 20, 30, 40, 50, 70, 100, 140, and 200 can be used to determine the weights of coal particles passing through each sieve in the range of (−) 1180 microns to (−) 75 microns.

2. For particles of from about 1 to (−) 75 microns diameter, a Sedigraph 5500L (manufactured by Micromeritics Company of Norcross, Ga., U.S.A.) can be used to measure the particle sizes and the number of particles in coal and in the coal-water slurry. This machine uses photo-extinction of settling particles dispersed in water according to Stroke's law to make the aforementioned determinations.

3. For particles less than about 1.0 microns in diameter, a scanning electron microscope (SEM) at 40,000× magnification can be used. The determination can be made by preparing a dilute suspension of coal particles or by diluting a sample of disperse coal-water slurry to a concentration of about 10 weight percent of coal (per weight of solution). The dilute suspension is allowed to settle for two hours (for example, in a 100 milliliter graduate cylinder), and samples of the finest sizes are taken from the top one milliliter of the suspension. The sample is further diluted with alcohol to a concentration of less than 0.5 percent and the diluted suspension or dispersion is examined on a copper pedestal using the SEM in a known way to find and measure the $D_S$.

By way of illustration and not limitation, the following procedures can be utilized to prepare coal samples for size measurements:

(a) Sieve analysis: A weighed sample, for example 50 grams dry weight of coal, is dispersed in 400 milliliters of carrier water containing one percent of "Lomar D" surfactant (based upon weight of dry coal), and the slurry is mixed for 10 minutes with a Hamilton Beach mixer. The sample is then allowed to stand quiescent for 4 hours; however, this step can be omitted if the slurry was milled with the surfactant. The sample is then remixed very briefly for about 2 minutes and poured slowly on a stack of tarred U.S. Standard sieves down to 325 mesh. The sample is then carefully washed with running water through the top sieve with the rest of the stack intact until all sievable material on that sieve is washed through the sieve into the underlying sieves. The top sieve is then removed, and each sieve in the stack, as it becomes the top sieve, is successively washed and removed until each sieve has been washed. The sieves are then dried in a dryer at 105 degrees centigrade for about 60–90 minutes in the same stack order used in the set sieveing. After drying the stack is further Ro-tapped for 15 minutes. The residue on each sieve is weighed in a known way. A separate sample is washed through a 140 mesh sieve and the underflow is collected for sedimentometer analysis.

(b) Sedigraph analysis: a 200 milliliter sample is used for the analysis. About 2 eyedroppers of the sample is further diluted in 30 milliliters of distilled water, and 4 drops of "Lomar D" are added to this diluted sample. The sample is then stirred for about 2 hours with a magnetic stirrer; measurement is then made with the Sedigraph 5500L.

The data from the sieve and Sedigraph analyses is combined with $D_S$ data obtained by a scanning electron microscope and is used to prepare a CPFT chart.

The coal-water slurry of this invention contains at least about 65 percent of solids (by weight of slurry), as measured on a dry basis. As used herein, the term "solids" includes the as-mined coal which may include, e.g., coal and ash. There is a considerable amount of bound water in coal as mined; the weight of this water in the coal is not included in the solids weight in order to calculate the weight percent of "dry" solids in the slurry of this invention. As used herein, the term "dry basis" refers to coal which is substantially free of carrier water. Coal is considered to be dry after it has been air dried by being exposed to air at a temperature of at least 70 degrees Fahrenheit and a relative humidity of less than 50 percent for at least 24 hours.

In a more preferred embodiment, the coal-water slurry of this invention contains at least about 70 weight percent of solids as measured on a dry basis. In one embodiment it is preferred that the coal-water slurry of this invention contain no more than about 85 weight percent of solids, as measured on a dry basis. In another embodiment, it is preferred that the coal-water slurry of this invention contain no more than 80 weight percent of solids, dry basis.

The coal-water slurry of this invention contains from about 15 to about 35 weight percent of carrier water. In one preferred embodiment, said coal-water slurry contains from about 20 to about 35 weight percent of carrier water. In another preferred embodiment, the coal-water slurry contains from about 15 to about 25 weight percent of carrier water.

In this specification, the concentrations of coal and carrier water in the coal-water slurry of this invention are calculated by calculating either the weight of the dry coal (air dried for 24 hours at 70° C. at a relative humidity of less than 50 percent) or carrier water and dividing it by the combined weights of the dry coal and the carrier water. As used in this specification, the term carrier water means the bulk or free water dispersed between the coal particles contiguous to the bound water layers on the particles. The term bound water as used herein, means water retained in the bound water layer and includes a fixed water layer adjacent to the surface of a particle.

The coal consist used in the coal-water slurry of this invention is comprised of at least about 5 weight percent of colloidal coal particles. As used herein, the term colloid refers to a substance of which at least one component is subdivided physically in such a way that one or more of its dimensions lies in the range of 100 angstroms and 3 microns. As is known, these are not fixed limits and, occasionally, systems containing larger particles are classified as colloids. See Encyclopedia Of Chemistry. 2d Edition, Clark et al (Reinhold, 1966), page 203.

It is preferred that, in the coal consist used in the slurry of this invention, at least 5 weight percent of the coal particles are smaller than about 3 microns. It is preferred that from about 5 to about 36 weight percent of the coal particles in said coal consist be smaller than 3 microns. In one preferred embodiment, from about 5 to about 20 weight percent of the coal particles in said coal consist are smaller than 3 microns. In another preferred embodiment, from about 7 to about 36 weight percent of the coal particles in said coal consist are smaller than 3 microns.

In the coal-water slurry of this invention, the Brookfield viscosity of the slurry at 75 weight percent of coal concentration is less than 4000 centipoise when measured at ambient temperature and 60 revolutions per minute; prior to conducting the viscosity test, the coal concentration of the slurry is adjusted, if need be, by adding or removing water from the slurry until the coal concentration is 75 weight percent. As used herein, the term "Brookfield viscosity" describes "viscosity" as measured by conventional techniques used to determine viscosity by means of a Brookfield Synchro-Lectric Viscosimeter (manufactured by the Brookfield Engineering Laboratories, Stoughton, Mass., U.S.A.). Brookfield viscosities referred to in this specification were measured in centipoise at ambient temperature and pressure at 60 revolutions per minute.

The Brookfield viscosity of the coal-water slurry of this invention is preferably less than about 3000 centipoise at 60 rpm and 75 percent solids content. It is preferred that the Brookfield viscosity of the coal-water slurry be from about 300 to about 2400 centipoise under such test conditions. For example, a coal-water slurry made at 76.1 weight percent coal, dry basis, was found to have a viscosity of about 2000 centipoise (see FIG. 1, B and C).

In one preferred embodiment, the coal-water slurry of this invention has a unique combination of viscosity properties which facilitate its pumping. When pumping a coal-water slurry through a pipe of constant diameter, the shear rate the slurry is subjected to is often constant; however, the diameter of the pipe used may change, in which case the shear rate will change; furthermore, as the slurry is being pumped to the burner, it is desirable to heat it in order to facilitate its atomization. It is desirable to have a coal-water slurry which, regardless of whether it is subjected to a constant shear with time, an increasing shear rate, and/or an increasing temperature has its viscosity decrease; the coal-water slurry of this invention unexpectedly possesses these properties.

The viscosity of the preferred coal-water slurry of this invention decreases at a constant shear rate with time, decreases at an increasing shear rate, and decreases at an increasing temperature. This property greatly enhances its pumpability.

In a preferred embodiment, the coal-water slurry of this invention is a yield-pseudoplastic fluid. The term yield pseudoplastic fluid, as used in this specification, has the usual meaning associated with it in the field of fluid flow. Specifically, a yield pseudoplastic fluid is one which requires that a yield stress be exceeded before flow commences, and one whose apparent viscosity decreases with increasing rate of shear. In a shear stress vs. shear rate diagram, the curve for a yield pseudoplastic fluid shows a non-linearly increasing shear stress with a linearly increasing rate of shear. In a "pure" pseudoplastic system, no yield stress is observed so that the curve passes through the origin. However, most real systems do exhibit a yield stress indicating some plasticity. For a yield pseudoplastic fluid, the viscosity decreases with increased shear rate.

In the preferred embodiment of this invention, the coal-water slurry of this invention is also thixotropic, i.e., its viscosity decreases with time at a constant shear rate. Furthermore, in this embodiment, the coal-water slurry has a negative temperature coefficient of viscosity, i.e., its viscosity decreases with increasing temperature.

The yield stress of the coal-water slurry of this invention is from about 0.1 to about 10 Pascals. It is preferred that said yield stress be from about 0.5 to about 7 Pascals, and it is most preferred that said yield stress be from about 0.75 to about 5 Pascals. As is known to those skilled in the art, the yield stess is the stress which must be exceeded before flow starts. A shear stress versus shear rate diagram for a yield pseudoplastic or a Bingham plastic fluid usually shows a non-linear hump in the rheogram at the onset of flow; extrapolating the relatively linear portion of the curve back to the intercept of the shear stress axis gives one the yield stress. See, for example, W. L. Wilkinson's "Non-Newtonian Fluids, Fluid Mechanics, Mixing and Heat Transfer" (Pergamon Press, New York 1960), pages 1–9, the disclosure of which is hereby incorporated herein by reference. Also see Richard W. Hanks, et al's "Slurry Pipeline Hydraulics and Design" (Pipeline Systems Incorporated, Orinda, California, 1980), pages II-1 to II-10, the disclosure of which is also hereby incorporated herein by reference.

A fluid with a high solids content and/or a high yield stress generally has a high viscosity. Applicant's coal-water slurry, although it has both a high solids content and a high yield stress, unexpectedly has a low viscosity. Furthermore, because of its high yield stress, the coal-water slurry of this invention has good stability properties.

It is preferred that at least 85 weight percent of the coal particles in the slurry have a particle size less than 300 microns. It is more preferred that at least 90 weight percent of the coal particles in the slurry have a particle size less than 300 microns. In the most preferred embodiment, at least 95 weight percent of the coal particles in the slurry have a particle size less than 300 microns.

It is preferred that the colloidal sized particles of coal in the coal-water slurry have a zeta potential of from about 15 to about 85 millivolts. As used herein, the term "zeta potential" refers to the net potential, be it positive or negative in charge; thus, a zeta potential of from about 15.4 to 70.2 millivolts includes zeta potentials of from about −15.4 to about −70.2 millivolts as well as zeta potentials of from about +15.4 to about +70.2 millivolts. In a more preferred embodiment, said zeta potential is from about 30 to 70 millivolts.

As used in this specification, the term "zeta potential" has the meaning given it in the field of colloid chemistry. Concise discussions and descriptions of the zeta potential and methods of its measurement are found in many sources, including, T. M. Riddick, U.S. Pat. No. 3,454,487, issued July, 1969; Douglas et al., U.S. Pat. No. 3,976,582, issued Aug. 24, 1976; Encyclopedia of Chemistry, 2nd edition, Clark et al., Reinbold Publ. Corp. 1966, pages 263–265; Chemical and Process Technology Encyclopedia, D. M. Considine, editor-in-chief, McGraw-Hill Book Company, N.Y., pages 308–309; Chemical Technology: An Encyclopedia Treatment, supra, Vol. VII, pages 27–32; Kirk-Othmer, Encyclopedia of Chemcial Technology, 2nd Edition, Vol. 22, pages 90–97; and T. M. Riddick, Control of Colloid Stability Through Zeta Potential, Zeta-Meter, Inc. New York City.

"Zeta potential" may be measured by conventional techniques and apparatus of electroosmosis such as those described, e.g., in Potter, "Electro Chemistry", Cleaver-Hume Press, Ltd.,; London (1961). Zeta potential can also be determined by measuring electrophoretic mobility (EPM) in any of several commercial apparatuses. In the present invention, a Pen-Kem System 3000 (made by Pen-Kem Co. Inc. of Bedford Hills, N.Y.) was used for determining zeta potential in the examples herein. This instrument is capable of automatically taking samples of coal particles and producing an EPM distribution by Fast Fourier Transform Analysis from which the average zeta potential can be calculated in millivolts.

The zeta potential is measured using very dilute samples of the $<10\ \mu m$ sized coal particles in the coal compact of the coal-water slurry.

It is preferred that the zeta potential of the colloidal sized coal particles in the coal consist of the slurry of this invention be negative in charge and be from about −15.4 to about −70.2 millivolts. It is more preferred that said zeta potential be from about −30 to about −70 millivolts.

In one preferred embodiment, the net zeta potential of said colloidally sized coal particles in the coal consist is either from about +15.4 to about +70.2 millivolts or about −15.4 to about −70.2 millivolts and the zeta potential of the non-coal "ash" particles in the slurry is either from about 0 to about 15.3 millivolts of from about 0 to about −15.3 millivolts. In this preferred embodiment, after the ash and the colloidal coal particles are charged to their specified zeta potentials, the ash is separated from the slurry by conventional separation techniques such as, e.g., those which are described in U.S. Pat. No. 4,217,109 and Bureau of Mines Reports No. RI 1960 (1974) and RI 7440 (1970) by Miller et al., the disclosures of which are hereby incorporated by reference into this specification.

It is preferred that the zeta potential of said colloidally sized coal particles be "near maximum". "Near maximum zeta potential", as used in this specification, means a value of zeta potential, measured at constant electrical conductivity, below the maximum zeta potential as defined and discussed in the references cited in the portion of this specification wherein the term "zeta potential" is defined. It is necessary to normalize the zeta potential values with respect to the electrical conductivity of the carrier fluid because zeta potential is limited by the electrical conductivity of the carrier fluid. The near maximum zeta potential should be of a millivoltage sufficient to provide the coal particles with a repulsive charge great enough to disperse the coal particles in the coal-water slurry. It is preferred that the zeta potential on the colloidal coal particles be from about 40 to about 90 percent of the maximum zeta potential. It is more preferred that the zeta potential on the colloidal coal particles be from about 40 to about 80 percent of the maximum zeta potential.

In the preferred embodiment of the coal-water slurry of this invention, if the zeta potential is at a maximum attainable millivoltage for the coal consist, the yield pseudoplastic rheology of the coal-water slurry may be shifted into a dilatent rheology and become too viscous to be pipeline pumpable. Thus, for this preferred embodiment the maximum zeta potential may be determined by measuring the Brookfield viscosity of the slurry at different zeta potentials. For a given system, maximum zeta potential has been reached when further increases in the surfactant concentration in the slurry do not further decrease the Brookfield viscosity of the system at 60 rpm.

One preferred means for measuring the zeta potential is to grind asample of coal in either a laboratory size porcelain ball mill with procelain balls in distilled water at 30 weight percent solids for approximately 24 hours or in a steel ball mill with steel balls at 30 weight percent solids for 16 hours or until all of the particles in the coal are less than 10 microns in size. Small samples of this larger sample can then be prepared in a known way by placing them in a vessel equipped with a stirrer with a sample of water to be used as a carrier in the coal-water slurry. Various acidic and basic salts are then added in incremental amounts to vary the pH, and various concentrations of various candidate dispersing agent organic surfactants likewise are added in incremental amounts (e.g., grams per gram coal, both dry basis), alone or in combinations of two or more. These samples are then evaluated in any electrophoretic mobility, electroosmosis, or streaming potential apparatus to determine electrical data, from which the zeta potential is calculated in a known way. Plots of zeta potential vs. pH vs. concentration may then be made to indicate candidate surfactants, or combinations thereof to be used to produce the optimum dispersion of coal particles in the carrier water below the amount at which dilatency may be reached. A Pen Kem System 3000 apparatus can be used in the determination described and can process 40 samples in about 6 hours.

In general, the identity of the most effective dispersing agents can be determined by measuring the effects of the zeta potentials upon the system at a given concentration; viscosity versus shear rate of the stirred coal-water slurry is measured while titrating with increasing amounts of the dispersing agent, and the point at which the slurry viscosity ceases to decrease is noted. Thus, for example, one can grind a sample of coal in a laboratory size ball mill with porcelain balls in water at 50 weight percent solids, e.g., for 24 hours or until all of the particles in the coal are less than 10 microns in size. Small samples (about 500 milliliters apiece) of the slurry can then be deflocculated by adding various dispersing agents to the samples dry or preferably in solution dropwise, blending the mixture gently, and then measuring the viscosity at some constant shear rate by, e.g., using a Brookfield LVT viscometer at 30 revolutions per minute. The dispersing agent (or combination of dispersing agents) which is found to produce the lowest viscosity for the system at a given shear rate and dispersing agent(s) concentration is the most effective for those conditions.

Figure 2:
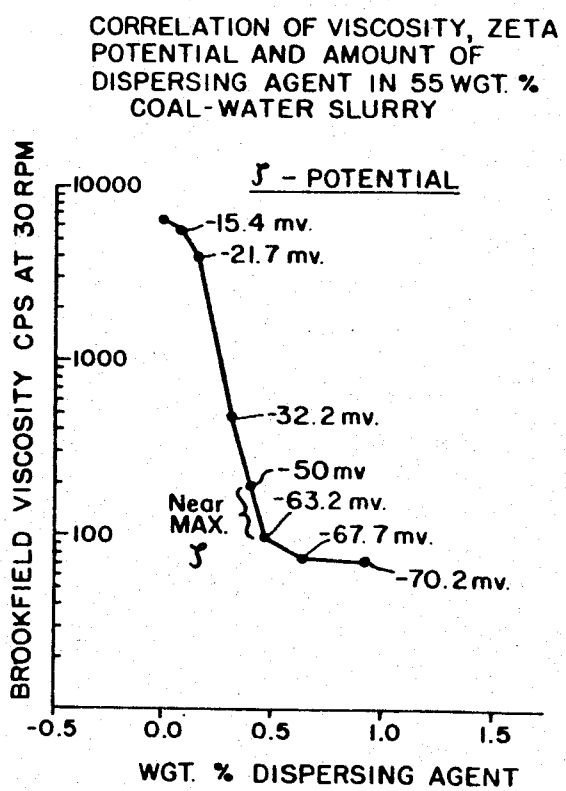
FIG. 2 is a chart showing correlation among Brookfield viscosities in cps at 30 rpm, zeta potentials in millivolts (mv) and percents of dispersing agent used in determining amount of dispersing agent needed to obtain near maximum zeta potential in a 55 wgt % coal-water slurry as further shown in FIG. 13.

The amount of dispersing agents used will vary, depending upon such factors as the concentration of the coal in the slurry, the particle size and particle size distribution, the amount of ash minerals, i.e. clays and other minerals present, the temperature of the slurry, the pH, the original zeta potential of the particles, and the particular dispersing agent(s), e.g., a deflocculant anionic organic surfactant, and its concentration. In general, the dispersing agent, e.g. the above deflocculant, is present in the slurry, at from 0.01 to 4.0 weight percent based on the weight of dry coal. Procedurally, in determining the amount of a specific dispersing agent needed, a series of measurements are made of viscosities versus shear rates versus zeta potential for a series of coal-water slurries containing a range of amounts of a particular dispersing agent for a constant amount of coal-water slurry. The data can be plotted as shown in FIGS. 2–5 and 13 and used as a guide to the optimum quantities of that agent to use to obtain near maximum zeta potential. The coordinate of the chart at which the viscosity and/or zeta potential is not decreased significantly by adding more agent is selected as an indication of the optimum quantity at maximum zeta potential, and the amount is read from the base line of the chart. The viscosity and amount read from the titration chart (FIGS. 2–5 and 13) is then compared with an equivalent chart showing a correlation among viscosity, amount and maximum zeta potential (FIG. 2). An amount of electrolyte and/or dispersing agent(s) required to provide a near maximum zeta potential and a selected viscosity is then used to make the coal-water slurry.

Figure 13:
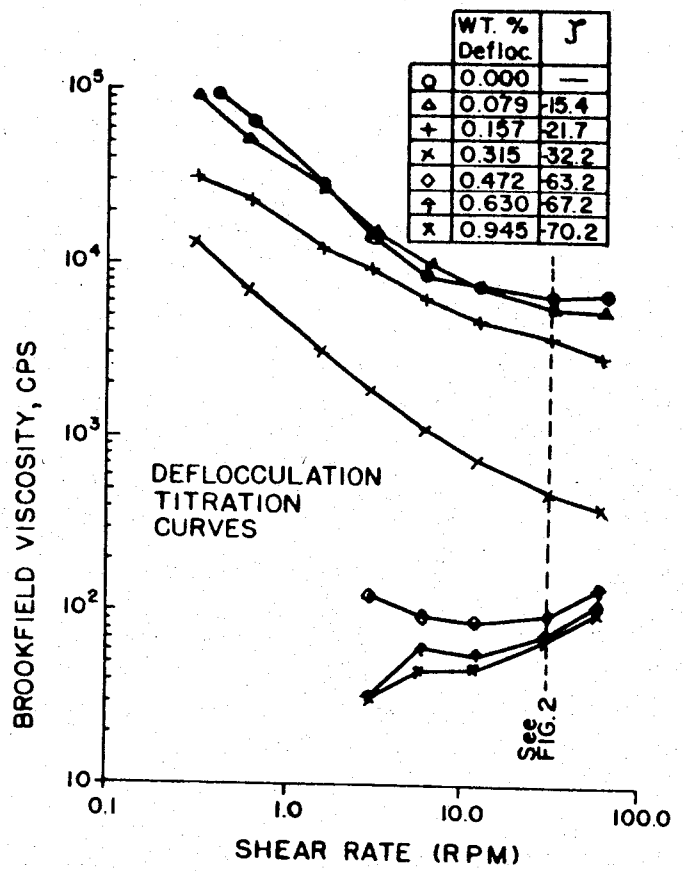
FIG. 13 is a chart illustrating titration curves derived in experimentally selecting electrolyte and/or dispersing agent(s) and determining the optimum wgt. % needed for dispersing coal particles in carrier water by addition of incremental amounts of agent, measuring shear rate in rpm after each addition, and correlating the shear rate in rpm with Brookfield viscosity in centipoises.

By way of illustration, screening tests were conducted on a coal sample from an Eastern Kentucky mine at 55 weight percent concentration with a sodium salt of condensed naphthalene sulfonic acid (sold as "Lomar D® by the Diamond Shamrock Process Chemicals Company) as a candidate deflocculating agent. Although in this illustration the coal content of the slurry was 55 weight percnt, a similar method would be used for coal slurries with coal concentrations in excess of 65 weight percent. The zeta potentials and Brookfield viscosities for different samples of this slurry to which different amounts of the dispersing agent had been added were determined. The zeta potential values obtained are shown in the inset of FIG. 13. The relationship of slurry viscosity and dispersing agent concentration was plotted, and this plot is shown in FIG. 2. Referring to FIG. 2, it is seen that the chart line formed from the data from the inset of FIG. 13 forms a distinctive curve. This curve shows that, as zeta potential increases from (−) 15.4 to (−) 67.7 millivolts, the Brookfield viscosity decreases from about 7000 centipoise to about 80 centipoise and then levels off at about 75 centipoise at about (−) 70.2 millivolts. From this data and the chart, it is indicated that, for this system, the maximum zeta potential is about (−) 70.2 millivolts, and the near maximum zeta potential is about (−) 63.2 millivolts.

Referring to FIG. 13, and its inset, it is seen that as the amount of deflocculant was increased from zero to 0.945 wgt. %, the zeta potential increased gradually with each incremental addition of Lomar D from (−) 15.4 mv at 0.079 wgt. % to (−) 70.2 mv at 0.945%. Simultaneously, as the shear rate (rpm) was increased during the time of presence of each incremental amount, the Brookfield viscosity is seen to decrease until it reaches a minimum value at 30 rpm, while the rheology of the system is seen to change from pseudoplastic to dilatent at a rate between 30 and 60 rpm.

From the aforementioned data it can be concluded that, for the aforementioned system, the amount of the sodium salt of condensed naphthalene sulfonic acid surfactant which would be used should be about 0.5 weight percent, based on the weight of the coal, both dry basis. To be on the safe side, the amount of surfactant can be decreased slightly to, e.g., about 0.45 weight percent or less.

Other methods for selecting the type and amount of dispersing agent needed to obtain a near maximum zeta potential in a coal consist made according to this invention will be apparent to those skilled in the coal-water slurry art.

Figure 3:
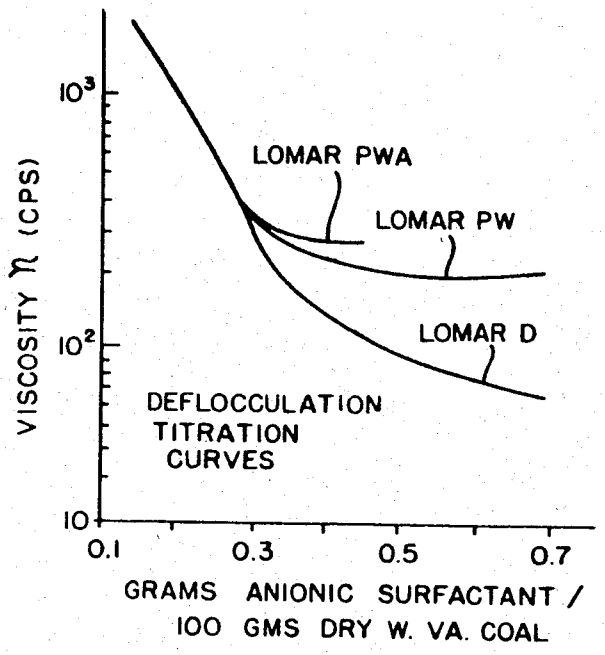
FIGS. 3, 4 and 5 are charts showing titration curves and illustrating correlations between Brookfield viscosities and amounts of electrolyte and/or dispersing agent(s) used in determining optimum amounts of agent(s) to be used to obtain lowest viscosities.

FIG. 3 shows semi-logarithmic plots of deflocculation curves obtained with varying amounts of sodium salt of condensed mono naphthalene sulfonic acid (Lomar D and Lomar PW) and of the ammonium salt of said sulfonic acid (Lomar PWA) dispersed in carrier water in parts of surfactant per 100 parts of ball milled W. Virginia coal (dry basis, 100 wgt. % 325 mesh (−) 45 μm) and having 10 wgt. % of particles minus 3 μm) in a coal-water-anionic organic surfactant slurry containing 55 wgt. % of coal. From this data it is concluded that rheological plasticity will be provided and retained at near maximum zeta potential when about 0.4 to 0.7 gm of the anionic surfactant is present per 100 gms of dry W. Virginia coal in a dispersed coal-water slurry containing 55 wgt. % of coal with the particle size distribution according to the Alfred formula.

Figure 4:
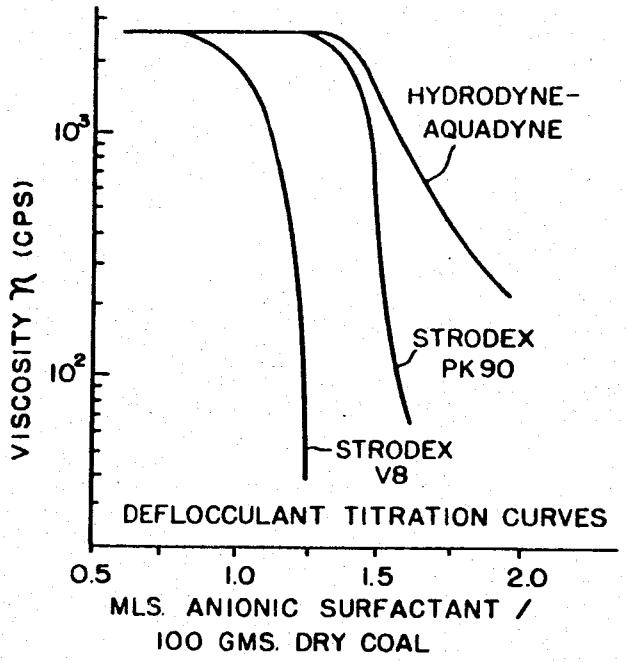

FIG. 4 similarly shows semi-logarithmic plots of deflocculation curves obtained with varying amounts of potassium salt of complex organic polyphosphate ester acid anhydride (Strodex V8 and Strodex PK-90) and of Hydrodyne-Aquadyne, a mixture of non-ionic wetting agents, dispersed in water in ml. of surfactant per 100 parts of ball milled West Virginia coal (dry basis, 100 wgt. % minus 325 mesh ((−) 45 μm), 10 wgt. % minus 3 μm) in a coal-water-anionic organic sufactant slurry containing 55 wgt. % of West Virginia coal slurry. From this data it is concluded that rheological plasticity will be provided and retained when about 1 to 2 mls of liquid anionic surfactant or of non-ionic wetting agents are present per 100 gms of dry coal in a dispersed coal slurry containing 55 wgt. % of coal with the particle size distribution according to the formula.

Quantities of other dispersing agents to use can be determined similarly. In general, the flow behavior of the slurry is controlled below the solids content or the dispersing agent additional level at which dilatency could begin to occur i.e. below the level at which viscosity increases as shear rate increases. Pumpability of the coal-water slurry is optimum under such rheological conditions but would decrease rapidly as dilatency is approached.

As discussed above, certain electrolytes, such as alkali inorganic compounds, can be added to the slurry to enhance the rheological plasticity of the slurry in the presence of an anionic organic surfactant. The effects of the addition of NaOH to 55% coal-water slurry wherein the West Virginia coal particles were 100 wgt. % minus 325 mesh and 10 wgt. % minus 3 μm and containing varying amounts of an anionic organic surfactant, Lomar D, are shown below.

| NaOH, % | Lomar D % | Brookfield Viscosity, cps at 60 rpm |
|---|---|---|
| 0.4 | 1.15 | 450 |
| 1.2 | 0.75 | 175 |
| 2.0 | 0.80 | 450 |

Figure 5:
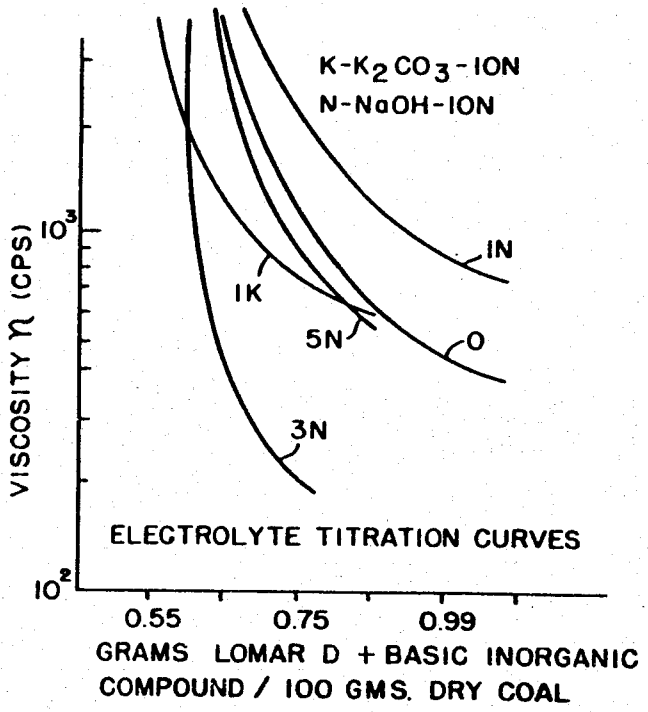

This data shows a ratio of NaOH to surfactant of 1.20/0.75 to provide an optimum low Brookfield viscosity of 175 cps at 60 rpm for this coal. From this data, it is apparent that rheological plasticity will be provided and retained when the above ratio of amounts of NaOH to Lomar D are used to prepare a coal-water slurry with this particular coal FIG. 5 shows deflocculation curves obtained using West Virginia bituminous coal-water slurry (wherein the coal particles were ball milled to provide 100 wgt. % minus 325 mesh and 10 wgt. % minus 3 μm), 67.4 wgt. % solids, deflocculated with from about 0.75 to 1.05 gms of Lomar D per 100 parts of coal (dry basis) and varying amounts of NaOH and $K_2CO_3$. The alkali materials were prepared as 10N solutions in water and added in various amounts by volume to the slurry. In FIG. 5, 0=0 ml; 1N=1 ml of 10N-NaOH; 3N=3 ml 10N-NaOH; 5N=5 ml 10N-NaOHl; and 1K=1 ml 10N-$K_2CO_3$. It is concluded from the deflocculation curves that the use of 3 ml of 10N-NaOH should provide optimum low viscosity with about 0.75 gm of Lomar D per 100 gms of coal in the coal-water slurry. As each ml of 10N-NaOH equals 0.4 gm of NaOH, dry basis, and each ml of 10N-$K_2CO_3$ equals 0.69 gm of $K_2CO_3$, the amount of alkali present in the slurries from which the data shown in the curves was obtained ranged from 0.4 to 2.0 gm per 100 gm of this coal.

In one embodiment, this invention relates to an improved method for preparing a coal-water slurry suitable for pipeline transport comprising dispersing finely-divided coal particles in water, characterized by the steps which comprise:

(i) providing a coal compact comprising finely-divided coal particles having particles sizes in the range of about 400 μm to 0.05 μm with at least 5 wgt. % of the particles being of colloidal size, said particles in said compact having a particle size distribution substantially in accordance with the following formula:

$$CPFT = \frac{D^n - D_S^n}{D_L^n - D_S^n} \cdot 100,$$

where

CPFT=cumulative weight percent, dry basis, of particles finer than a particle of stated size, D, D=diameter of any particle in the compact, $D_L$=diameter of largest particle in compact, sieve size or its equivalent, being from about 38 to about 400 microns, $D_S$=diameter of smallest particle in compact, being from about 0.01 to about 0.4 microns, and n=numerical exponent, with n being from about 0.2 to about 0.5 and with all diameters sized in microns.

(ii) providing carrier water in a total amount at least sufficient to transport said coal compact is a pipeline, (iii) determining the voltage and polarity of the zeta potential of a sample of coal particles from said coal compact when dispersed in a sample of said carrier water, (iv) determining from the results of step (iii) the type and amount of zeta potential enhancing electrolyte and/or dispersing agent(s) needed to adjust the zeta potential of at least the colloidal particles of said coal compact when mixed with said carrier water to a voltage near maximum zeta potential and sufficient to disperse said coal particles, (v) providing in said coal compact of step (i), or in said carrier water of step (ii), or in a mixture thereof the type and amount of zeta potential enhancing dispersing agent(s) determined to be needed from step (iv), and (vi) blending said coal compact, carrier water, and dispersing agent(s) together to form said coal-water slurry.

In the coal compact of the coal-water slurry of this invention, said n is from about 0.20 to about 0.50. It is preferred that said n be from about 0.27 to about 0.42. In the most preferred embodiment, n is from about 0.33 to about 0.37.

In one of the preferred embodiments of the coal-water slurry of this invention, said dispersing agent is an anionic organic surfactant and the pH of the slurry is from about 5 to about 12. In a more preferred embodiment, the pH of the slurry is from about 7 to about 11.

In another embodiment of this invention, a novel coal-water slurry containing from about 65–85 weight percent of coal, dry basis, is preferred by the method which comprises:

(i) pulverizing, in the presence of a pre-determined portion of the total amount of dispersing agent(s) and in a minor amount of all the carrier water needed to transport said coal-water slurry in a pipeline, a first fraction of coal to prepare a pulverized dispersed coal fraction having particles substantially all finer than about 300 μm.

(ii) providing with a major amount of all said water and in the presence of the remaining portion said predetermined amount of said dispersing agent(s) a second fraction of pulverized dispersed coal having coal particles of a fineness such that, when blended with said first fraction of coal particles to form a coal compact, the total blended mass will form a compact which contains a net of about 10 wgt. % of particles which are less than 3 μm in size and (iii) blending said first and second fractions together in amounts by weight sufficient to provide a coal-water slurry having a coal compact with coal particles having a size in the range of about 300 μm×0.1 μm with at least about 10 wgt. % of said particles less than 3 μm in size and distributed substantially in accordance with the following formula:

$$CPFT = \frac{D^n - D_S^n}{D_L^n - D_S^n} \cdot 100$$

In a more preferred embodiment, the above preferred method includes the further improvement wherein: said total amount of said at least one dispersing agent(s) is predetermined by:

(iv) determining the voltage and polarity of the zeta potential of a sample of coal particles milled to $<10$ μm from said coal and dispersed in a sample of said carrier water, and (v) determining from the results of step (iv) the type and amount of zeta potential enhancing dispersing agent(s) needed to adjust the zeta potential of at least the colloidal particles of said coal compact when mixed with said carrier water to a voltage near maximum zeta potential.

In certain embodiments, it may be difficult to grind a coal or coal-water slurry until it contains from about 5 to about 36 weight percent of colloids. In such a case, one may grind the coal or coal-water slurry, thereafter blend it with another coal or coal-water slurry to obtain a product containing the required amount of colloidal particles, and thereafter prepare the coal-water slurry of this invention.

The coal slurry of this invention is comprised of a coal compact containing particles with a specified particle size distribution. The term "coal compact", as used in this specification, describes a mass of finely divided coal particles which are closely packed in substantial accordance with the following equation:

$$CPFT = \frac{D^n - D_S^n}{D_L^n - D_S^n} \cdot 100.$$

Figure 10:
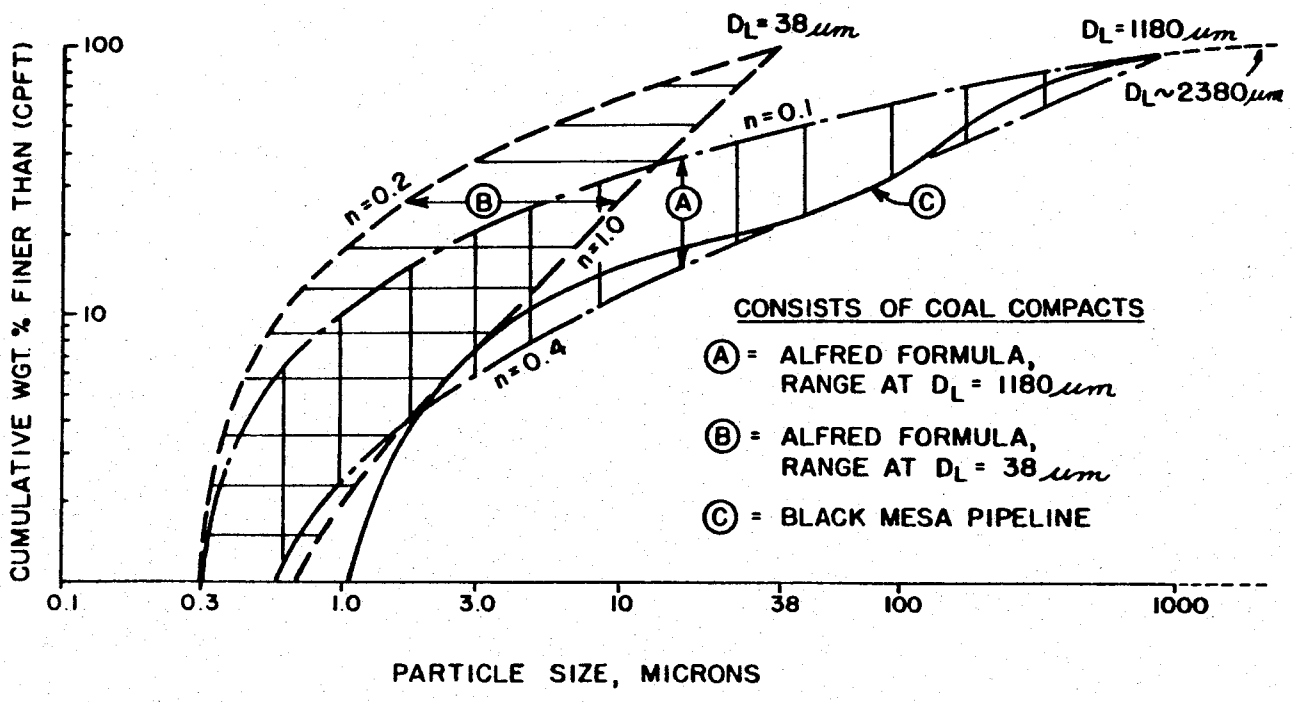
FIG. 10 is a chart showing correlations between particle size distributions (consists) by wgt. % and particle sizes in microns of ranges of coal compacts made according to a consist formula at $D_L=1180$ μm and at $D_L=38$ μm with $D_S<$ μm in each consist, and further compared with a chart line plot of a coal compact representative of a commercial Black Mesa coal-water slurry.

For given $D_L$, $D_S$, and n, the values of CPFT can be calculated for different particle sizes (Du), and a CPFT curve for the given values of n, $D_L$, $D_S$ can be generated (see FIG. 10).

The compact used in the applicant's coal-water slurry has a particle size distribution which is substantially in accordance with the CPFT formula, but it does not necessarily perfectly fit the curve generated by said formula exactly. Although the CPFT chart line curve is preferably free of peaks and valleys and is substantially non-undulating, minor variations from the ideal CPFT curve are premissible. As long as, for a given set of values for n, $D_L$, and $D_S$, each CPFT value for a given particle size (Du) is within plus or minus 5 percent of the ideal CPFT value, then the slurry is "in substantial accordance" with the CPFT formula and is within the scope of the claimed invention. Thus, for example, if for a given n, $D_L$, $D_S$, at D, the CPFT is 30 percent, then for said values CPFT's of from 25 percent to 35 percent are within the scope of the invention.

The particle size distribution of the coal compact according to the above formulation for CPFT provides a substantially non-undulating size distribution of particles which permits closer packing of more particles of coal in a specific volume of space in the compact than can be achieved with a particle size distribution which has an undulating distribution of particles. Also sizes of $D_L$ and $D_S$ have important effects on the stability of the particle size distribution for use in the coal-water slurry. When $D_L$ is too large, large particles can settle out and cause pumping problems. When $D_S$ is too large and less than about 5 wgt. %, dry basis, of particles of colloidal size in present in the coal compact, the stability if the yield stress and the rheological properties of the coal-water slurry are adversely affected and the slurry may segregate or become dilatent or otherwise not pumpable. The value of the numerical exponent n in the formula CPFT is affected by the values of $D_L$ and $D_S$.

The term "CPFT chart line", as used herein in relation to the coal particle compact means a "particle size distribution line" representative of the consist of the coal compact (i.e., its particle size distribution). For example, when CPFT (e.g., in weight percent) is plotted against particle sizes (e.g., in microns) on a log-log chart, a smooth line is prefectly formed on the chart when the points of the plots are connected by a continuous line. As indicated about, the CPFT chart line may have a slope of up to 1.0, but should preferably be substantially free of peaks and valleys, referred to herein as "inflections" or undulations. The slope of the CPFT/D curve taken tangent to point $D_L$ (where the extraplated CPFT curve intersects the upper x axis) is equal to n.

The aforementioned CPFT equation was used to prepare a series of computer printouts of CPFT values for various stated particles Du over a range of particles sizes for Du ranging from $D_S$ $D_L$ for a range of nominal exponent n values in a parameter range which would provide at least 5 wgt. % of particles of size $3<$ μm for each value of n at selected $D_L$ and $D_S$ values. Illustrative typical and preferred values computed for typical consists of coal compacts which can be made in accordance with the equation while meeting the above limitation of at least 5 wgt. % of (−) 3 μm particles in the compact are shown in Table 1 which illustrates the compositions of typical and preferred consists of 300 μm×0.3 μm coal compacts which can be made in accordance with the equation for coal compacts having $D_L$ of about 300 μm, $D_S$ of about 0.3 μm and nominal n values of 0.2, 0.3, 0.5 and 0.6 while providing at least 5 wgt. % of particles of minus 3 μm size. As can be seen from the data, at an n value of 0.2, the consist will have CPFT of about 20.5 wgt. % for a stated particle Du of $<3$ μm size, and at an n value of 0.6, the consist will have CPFT of about 5.0 wgt. % for a stated particle Du of $<3$ μm size. It is to be understood that $D_S$ can be any $D_S$ in the range from 0.05 to 0.4 microns. Accordingly, comparable computer printouts of typical consists can be made where $D_S$ in the formula is held constant at any value between 0.05 μm and 0.4 microns. The data so derived can be used to prepare a compact and a coal-water slurry having a consist in accordance with the corresponding Alfred formula consist.

TABLE 1

| TYPICAL CONSISTS OF 300 μm × 0.3 μm COAL COMPACTS | | | |
|---|---|---|---|
| STATED PARTICLE | NOMINAL n VALUES WHERE CPFT IS AT LEAST 5 WGT. % WHEN D IS 3 μm | | |
| D SIZE IN μm | 0.2 CPFT | 0.3 CPFT | 0.5 CPFT |
| 0.3 | 0.0 | 0.0 | 0.0 |
| 0.4 | 2.5 | 1.6 | 0.6 |
| 0.6 | 5.2 | 3.5 | 1.4 |
| 0.8 | 8.1 | 5.5 | 2.3 |
| 1.2 | 11.3 | 7.8 | 3.4 |
| 1.8 | 14.7 | 10.4 | 4.8 |
| 2.6 | 18.3 | 13.3 | 6.4 |
| 3.8 | 22.2 | 16.5 | 8.3 |
| 5.4 | 26.4 | 20.0 | 10.7 |
| 7.9 | 30.9 | 24.0 | 13.5 |

TABLE 1-continued

| TYPICAL CONSISTS OF 300 μm × 0.3 μm COAL COMPACTS | | | |
|---|---|---|---|
| STATED PARTICLE | NOMINAL n VALUES WHERE CPFT IS AT LEAST 5 WGT. % WHEN D IS 3 μm | | |
| D SIZE IN μm | 0.2 CPFT | 0.3 CPFT | 0.5 CPFT |
| 11.3 | 35.8 | 28.4 | 16.8 |
| 16.3 | 41.0 | 33.4 | 20.8 |
| 23.5 | 46.7 | 38.9 | 25.6 |
| 33.8 | 52.7 | 45.0 | 31.4 |
| 48.7 | 59.2 | 51.9 | 38.3 |
| 70.0 | 66.2 | 59.5 | 46.6 |
| 100.7 | 73.8 | 68.0 | 56.5 |
| 144.9 | 81.9 | 77.5 | 68.5 |
| 208.5 | 90.6 | 88.1 | 82.8 |
| 299.9 | 99.9 | 99.9 | 99.9 |

Figure 12:
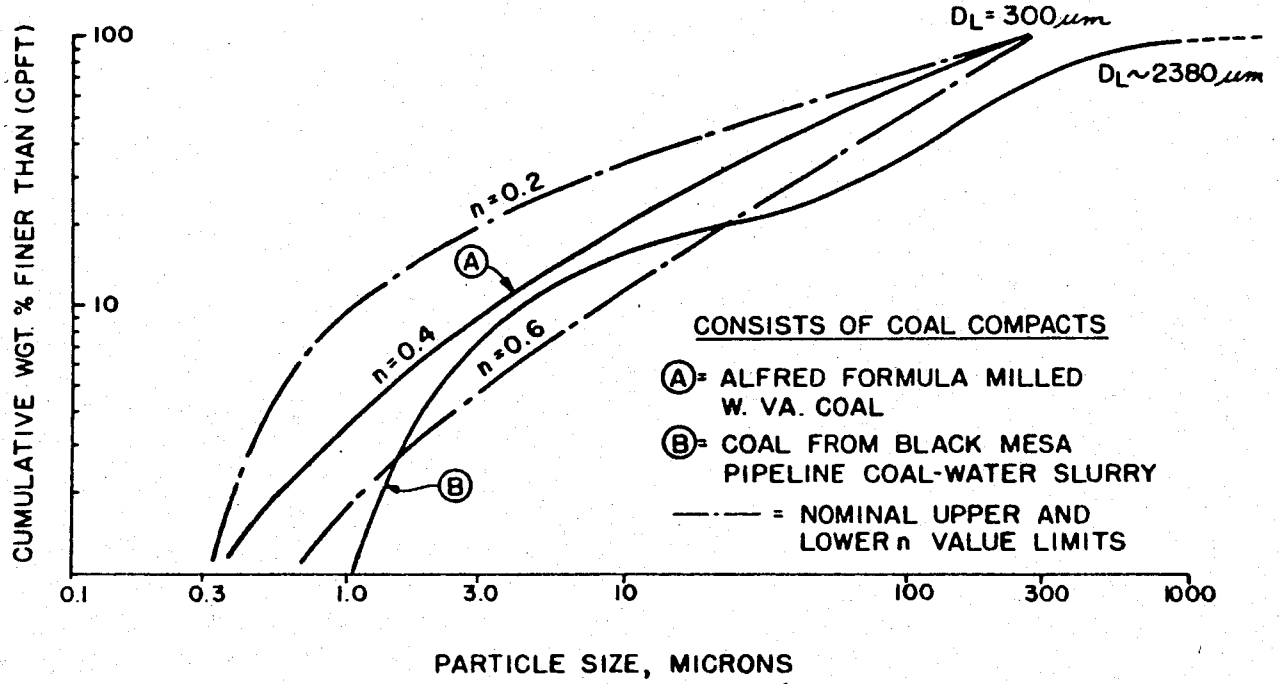
FIG. 12 is a chart showing correlations between consists by wgt. % and particles sizes in microns of a coal compact milled from West Virginia coal to a consist with $D_L=300$ μm and $D_S=1.0$ μm and a coal compact representative of Black Mesa coal-water slurry, and further illustrating nominal upper and lower n value limits for the consist.

When the CPFT equation is followed closely, as shown in FIG. 12 and Table 1, for example, optimum practical particle packing with minimum void volume is obtained for a coal-water slurry. By minimizing void spaces of a compact of coal particles it is obvious that a minimum amount of carrier water is needed to fill those voids. This in turn reduces the total amount of water needed for obtaining system fluidity.

For obtaining maximum fluidity in a prepared coal-water slurry, the consist of the compact used to make the slurry should follow the equation from $D_L$ to $D_S$ as closely as practically possible, and preferably, exactly, with n having a substantially constant value in the formula depicting the actual distribution size. Some fluctuations are found to commonly occur in bimodal blends and tend to decrease the packing efficiency. Such fluctuations will cause n values to fluctuate also. However, it is still possible to obtain pipeline pumpable slurries if the actual distribution is relatively close to that required by the Alfred formula for particular values of $D_L$ and $D_S$. It has been further found that rapid fluctuations in the values of n over the range of particle sizes from $D_L$ to $D_S$ are indicative of a non-uniform distribution of particle sizes in a compact in the range between $D_L$ and $D_S$.

It has been found that producing in a coal compact a total particle size spectrum described by the equation will produce a low viscosity slurry in the presence of appropriate electrolyte and/or dispersing agent(s).

For practice of this invention, it is preferred that the coal particles present in the coal compact and in the slurry be provided to have as close a particle size distribution as possible to the equation. In one method, this can be done by grinding coal under grinding conditions which can be carried out and controlled in a known way until the desired $D_L$, $D_S$ and Alfred particle size distribution in a desired n range for the coal compact is obtained. In a second method, a similar coal compact can be provided by blending several grinds of milled powders of coal to make a blend to obtain a similar particle size distribution in the compact as described by the above values, with a maximum solids content and with minium void volume. Coal compacts prepared according to the equation can be used to prepare pipeline pumpable coal-water slurries having a minimum carrier water content and a low viscosity. For example, slurries of this invention have been produced having 77.5 wgt. % of solids, dry basis, and a Brookfield viscosity at 60 rpm less than 2000 cps (FIG. 1C). Similarly, by using a proper combination of steps, slurries may be produced having 80 wgt. % of solids dry basis, and a Brookfield viscosity at 60 rpm less than 4000 cps and be suitable for pumping in a short distance pipeline. In practicing the invention, it has been found that a large yield stress is required in the coal-water slurry when $D_L$ is large, e.g. 400 μm, whereas a small yield stress is required when $D_L$ is small, e.g. <40 μm. Also, if low viscosity pumping requirements are more important for a particular use condition than is storage stability, then a lower viscosity Newtonian or pseudoplastic slurry with no yield stress can be produced.

The other two steps required for making the coal-slurry hereof, i.e. the electrolyte enhancement of the bound water layer to control the water structure, and the dispersing of the coal particles and maintaining them at near maximum zeta potential, are both achieved by chemical treatments of the water present on and between coal particles in the coal-water slurry. Together with the Alfred consist compact, these elements determine the nature of the plasticity of the slurry.

It is preferred that the coal-water slurry of this invention be comprised of an amount of dispersing agent effective to maintain the particles of coal in dispersed form in the carrier water of the slurry, to generate a yield stress in the slurry of from about 1 to about 10 Pascals, and to change the colloidal coal particles in the slurry to a net potential of from about 15 to about 85 millivolts. It is preferred that the coal-water slurry of this invention contain from about 0.01 to about 4.0 percent, based on weight of dry coal, of at least one dispersing agent. It is more preferred that the slurry contain from about 0.03 to about 1.8 percent, based on weight of dry coal, of dispersing agent. In an even more preferred embodiment, the slurry contains from about 0.05 to about 1.4 percent, by weight of dry coal, dispersing agent. In the most preferred embodiment, the slurry contains from about 0.10 to about 1.2 percent of dispersing agent.

Any dispersing agent which disperses the coal particles in the water and imparts the specified yield stress and zeta potential values to the slurry can be used. As is known to those skilled in the art, the dispersing agent can be inorganic. Thus, for example, sodium hydroxide can be used with some coal. The dispersing agent can be, and preferably is, organic, i.e., it contains carbon. The dispersing agent is preferably an anionic organic surfactant, and it imparts stability to the slurry.

The term "stability" as used herein includes static and dynamic stability and as applied to a coal-water slurry of this invention means the capability of the slurry to maintain its level of homogeneity over a selected period of time, such as, for example, a time measured from formation of the slurry with its particles dispersed at near maximum zeta potential to the time at which the slurry tends to undergo a change in its rheological properties. The term stability implies that the physical state of the slurry will not readily change or undergo fluctuations which would impair its use. For example, it implies that coarser particles will not settle out of the suspension and that neither segregation of coarse from fine particles nor over-flocculation of the coal particles will occur. Segregation of particles would alter particle packing efficiency and adversely affect the rheological properties of the slurry.

It is preferred that the dispersing agent used in the coal-water slurry of this invention be an organic compound which encompasses in the same molecule two dissimilar structural groups, e.g., a water soluble moiety, and a water insoluble moiety. It is preferred that said dispersing agent be a surfactant. The term "surface-active agent", or "surfactant", as used in the prior art indicates any substance that alters energy relationships at interfaces, and, in particular, a synthetic organic compound displaying surface activity including wetting agents, detergents, penetrants, spreaders, dispersing agents, foaming agents, etc. Concise Chemical and Technical Dictionary, H. Bennett, Chemical Publ., Inc. N.Y., 1962.

The surfactant used in the coal-water slurry of this invention is preferably an organic surfactant selected from the group consisting of anionic surfactants, cationic surfactants, and amphoteric surfactants. It is preferred that the surfactant be either anionic or cationic. In the most preferred embodiment, the surfactant is anionic.

It is preferred that the molecular weight of the surfactant used in the coal-water slurry of this invention be at least about 200. As used herein, the term "molecular weight" refers to the sum of the atomic weights of all the atoms in a molecule.

In one preferred embodiment, the surfactant is anionic and its water solubilizing group(s) is selected from the group consisting of a carboxylate group, a sulfonate group, a sulfate group, a phosphate group, and mixtures thereof. By way of illustration, one of these preferred anionic surfactants is a polyacrylate having the general formula

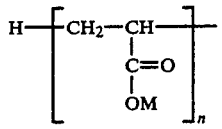

wherein n is a whole number of at least 3 and M is selected from the group consisting of hydrogen, sodium, potassium, and ammonium.

In another preferred embodiment, the surfactant is cationic and its water solubilizing group(s) is selected from the group consisting of a primary amine group, a secondary amine group, a tertiary amine group, a quaternary ammonium group, and mixtures thereof.

In yet another embodiment, the surfactant is amphoteric. In this embodiment, the surfactant has at least one water solubilizing group selected from the group consisting of a carboxylate group, a sulfonate group, a sulfate group, a phosphate group, and mixtures thereof; and the surfactant also has at least one water solubilizing group selected from the group consisting of a primary amine group, a secondary amine group, a tertiary amine group, a quaternary ammonium group, and mixtures thereof.

In one of the more preferred embodiments, the surfactant used in the coal-water slurry of this invention is comprised of at least about 85 weight percent of a structural unit of the formula.

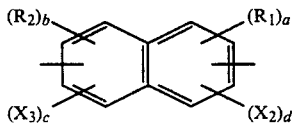

wherein $R_1$, $R_2$, $X_2$, a, b, c, and d are as hereinbefore defined and $X_3$ is selected from the group consisting of a carboxylate group, a sulfonate group, a sulfate group, a phosphate group, a nitro group, a halo group selected from the group consisting of chloro, bromo, fluoro, and iodo, —CN, an alkoxy group containing from 1 to about 6 carbon atoms, and a group of the formula $—R_3OR_4$ wherein $R_3$ and $R_4$ are an alkyl containing from about 1 to about 3 carbon atoms. The starting materials which can be used to prepare these surfactants are well known to those skilled in the art and include, e.g., naphthalene-αsulfonic acid (dihydrate), naphthalene-β-sulfonic acid (monohydrate). α-nitronaphthalene, β-nitronaphthalene, α-naphthylamine, β-naphthylamine, α-naphthol, β-naphthol, α-naphthoic acid, β-naphtoic acid, α-chloronaphthalene, α-bromonaphthalene, β-bromonaphthalene, β-chloronaphthalene, α-naphthonitrile, β-naphthonitrile, 1,5-dinitronaphthalene, 1,8-dinitronaphthalene, β-methylnaphthalene, 1-nitro-2-methylnaphthalene, 2-methylnapthalene-6-sulfonic acid, 2,6-dimethylnaphthalene, β-6-methylnaphthoylpropionic acid, 1,6-dibromo-2-naphtol, 6-bromo-2-naphtol, 1,6-dibromonaphthalene, 6-bromo-2-naphtol, and the like. Again, it is preferred that at least one of the atoms in this surfactant be an alkali metal selected from the group consisting of sodium, potassium, ammonium, and mixtures thereof. One of the most preferred surfactants from this group is the alkali metal salt of a condensed mono naphthalene sulfonic acid. This acid, whose preparation is described in U.S. Pat. No. 3,067,243 (the disclosure of which is is hereby incorporated by reference into this specification), can be prepared by sulfonating naphthalene with sulfuric acid, condensing the sulfonated naphthalene with formaldehyde, and then neutralizing the condensate so obtained with sodium hydroxide. This alkali or $NH_4^+$ metal salt of a condensed mono naphthalene sulfonic acid is comprised of at least about 85 weight percent of a repeating structural unit of the formula

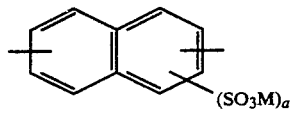

wherein M is an alkali metal selected from the group consisting of sodium, potassium, and ammonium and a is an integer of from 1 to 8. Comparable compounds with a benzene rather than naphthalene nucleus also can be used.

Examples of anionic organic surfactants which have been found particularly advantageous for providing yield pseudoplastic rheological properties to coal-water slurries, particularly those containing about 65 to 85 weight % of West Virginia or Black Mesa, Arizona coal, are shown in Table 2. In some cases, mixtures of two or more of these surfactants beneficially can be used.

Most preferably the deflocculating agent is selected from the group of anionic organic surfactants consisting of:

(i) 2-ethylhexyl polyphosphoric ester acid anhydride and its potassium salt,
(ii) complex organic polyphosphoric ester acid anhydride and its potassium salt,
(iii) Condensed mononaphthalene sulfonic acid and its sodium and ammonium salts, and
(iv) mixtures thereof.

TABLE 2

| Anionic Organic Surfactant | Tradename | Form | % conc. |
|---|---|---|---|
| 2-ethylhexyl polyphosphoric ester acid anhydride | Strodex MO-100 | Liquid | 100 |
| Potassium Salt of MO-100 | Strodex MOK-70 | Paste | 70 |
| Complex organic polyphosphoric ester acid anhydride | Strodex MR-100 | Liquid | 100 |
| Complex organic polyphosphoric ester acid anhydride | Strodex SE-100 | Liquid | 100 |
| Complex organic polyphosphoric ester acid anhydride | Strodex P-100 | Liquid | 100 |
| Complex organic polyphosphoric ester acid anhydride | Strodex PK-90 | Liquid | 90 |
| Potassium salt of complex organic polyacid anhydride | Strodex MRK-98 | Liquid | 98 |
| Potassium salt of complex organic polyacid anhydride | Strodex SEK-50 | Liquid | 50 |
| Potassium salt of complex organic polyacid anhydride | Strodex PSK-58 | Liquid | 58 |
| Potassium salt of complex organic polyacid anhydride | Strodex V-8 | Liquid | 85 |
| Sodium salt of condensed mono naphthalene sulfonic acid | Lomar D Lomar NCO Lomar PW | Powder | 86–90 |
| Sodium salt of condensed mono naphthalene sulfonic acid | Lomar LS | Powder | 95 |
| Ammonia salt of condensed mono naphthalene sulfonic acid | Lomar PWA | Powder | 89 |
| Solution of sodium salt of condensed mono naphthalene sulfonic acid | Lomar PL | Liquid | 45 |

Strodex is a trademark of Dexter Chemical Corporation.

Lomar is a trademark of Diamond Shamrock Process Chemicals, Inc.

While the use of the sodium, potassium or ammonium salts of condensed mononaphthalene sulfonic acid is preferred, it is to be understood that the condensed mononaphthalene sulfonic acid can be used with the addition of sodium, potassium, or ammonium alkali to form the corresponding alkali metal salt of that acid in situ.

Applicant does not wish to be bound to any particular theory. However, he believes that a dispersing agent in a coal-water slurry according to his invention performs at least three functions. In the first place, it is believed that a water soluble dispersing agent, which also serves as a wetting agent, such as an organic surfactant, functions, is necessary, and can be used to promote the wettability of the coal particles by water. As used herein, the term "wetting" indicates covering or penetrating the coal particle surface with a bound water layer. Such a wetting agent might or might not be needed, depending upon the surface chemistry of the coal and the associated electrochemistry of its inherent bound water layers. For example, inherent bed moisture and chemical compounds already present in natural coal deposits may allow wetting of the ground coal by added water.

In the second place, a dispersing agent functions to promote deflocculation of coal particles, preferably in the presence of advantageous electrolytes. As used herein, the term "deflocculating" indicates dispersion of particles, preferably of colloidal sized coal particles. Thus, e.g., a "deflocculating agent" includes a dispersing agent which promotes formation of a colloidal dispersion of colloidal sized particles in a coal-water slurry. It has been found that the presence of large, monovalent cations—such as $Na^+$, $Li^+$, or $K^+$—tend to promote deflocculation of colloidal sized coal particles in a coal-water slurry. However, higher valence cations—such as $Ca^{+2}$, $Al^{+3}$, and $Mg^{+3}$—tend to cause said coal particles to flocculate under certain conditions. Consequently, an organic anionic surfactant which wets the coal particles and contains a residual Na and/or K and an Li can be a very effective deflocculant for the coal-water slurry of this invention.

In the third place, in some cases the dispersing agent enhances the pumpability of the coal-water slurry. It is believed that this effect occurs because of enhancement or inhibition of the bound, or semi-rigid, water layer because the dispersing agent provides a cation as a counterion for the bound water layer, thereby affecting the yield pseudoplastic index (slope of a plot of log viscosity versus log shear rate) of the mass. Preferably, the cation provided by the dispersing agent is $NH_4^+$, $Na^+$ and/or $K^+$. Consequently, it is preferred to incorporate an advantageous electrolyte, such as an ammonium or alkali metal base, into the coal-water slurry to increase deflocculation of the slurry and thus improve its yield pseudoplasticity. However, it should be noted that the incorporation of an alkaline earth metal base into the slurry is substantially ineffective in promoting deflocculation.

It is preferred that the dispersing agent(s) used in the coal-water slurry of this invention provide one or more ions to the coal-water slurry. As used in this specification, the term "ion" includes an electrically charged atom, an electrically charged radical, or an electrically charged molecule.

In one preferred embodiment, the dispersing agent(s) used in the slurry of this invention provides one or more counterions which are of opposite charge to that of the surface of the coal particles. The charge on the surface of the coal particles is generally negative, and thus it is preferred that said counterions have a positive charge. The most preferred positively charged ions are the sodium and potassium cations.

In one embodiment it is preferred that the dispersing agent(s) used in the coal-water slurry of this invention be a polyelectrolyte which preferably is organic. As used in this specification, the term "polyelectrolyte" indicates a polymer which can be changed into a molecule with a number of electrical charges along its length. It is preferred that the polyelectrolyte have at least one site on each recurring structural unit which, when the polyelectrolyte is in aqueous solution, provides electrical charge; and it is more preferred that the polyelectrolyte have at least two such sites per recurring structural unit. In a preferred embodiment, said sites comprise ionizable groups selected from the group consisting of ionizable carboxylate, sulfonate, sulfate, and phosphate groups. Suitable polyelectrolytes include, e.g., the alkali metal and ammonium salts of polycarboxylic acids such as, for instance, polyacrylic acid; the sodium salt of condensed naphthalene sulfonic acid; polyacrylamide; and the like.

In one preferred embodiment, the coal-water slurry of this invention contains from about 0.05 to about 4.0 weight percent, by weight of dry coal in the slurry, of an electrolyte which, preferably, is inorganic. As used in this specification, the term "electrolyte" refers to a substance that dissociates into two or more ions to some extent in water or other polar solvent. This substance can be, e.g., an acid, base or salt.

In a more preferred embodiment, the coal-water slurry of this invention is comprised of from about 0.05 to about 2.0 weight percent of an inorganic electrolyte.

In the most preferred embodiment, said coal-water slurry is comprised of from about 0.1 to about 0.8 weight percent of said electrolyte. In the most preferred embodiment, the coal-water slurry contains from about 0.1 to about 0.5 percent of inorganic electrolyte.

Any of the inorganic electrolytes known to those skilled in the art can be used in the coal-water slurry of this invention. Thus, by way of illustration and not limitation, one can use the ammonia or alkali metal salt of hexametaphosphates, pyrophosphates, sullates, carbonates, hydroxides, and halides. Alkaline earth metal hydroxides can be used. Other inorganic electrolytes known to those skilled in the art also can be used.

In one preferred embodiment, the inorganic electrolyte is of the formula $$Ma(Z)b$$

wherein M is an alkali metal selected from the group consisting of lithium, sodium, potassium, rubidium, cesium, and francium; b is the valence of metal M; a is the valence of anion Z; and Z is an anion selected from the group consisting of hexametaphosphate, pyrophosphate, silicate, sulfate, carbonate, hydroxide, and halide anions. It is preferred that Z be selected from the group consisting of carbonate, hydroxide, and silicate anions. The most preferred electrolytes are selected from the group consisting of potassium carbonate, sodium hydroxide, and $Na_2SiO_3{:}9H_2O$ It is preferred that the coal-water slurry of this invention contain both said dispersing agent(s) and said inorganic electrolyte(s) and that from about 0.05 to about 10.0 parts (by weight) of the inorganic electrolyte are present for each part (by weight) of the dispersing agent(s) in the slurry.

It is preferred that the total concentration of both the dispersing agent(s) and/or the organic electrolyte be from 0.05 to 4.0 weight percent.

In one preferred embodiment, the coal-water slurry of this invention is comprised of dispersing agent(s) and inorganic electrolyte agents(s) which agents, when dissolved in water, provide electrically charged ions to the slurry. The amount of electrically charged ions preferably present in the slurry ranges from about 0.01 to about 2.5 weight percent, based upon weight of dry coal, and most preferably is from about 0.05 to about 2.0 weight percent. Said concentration of electrically charged ions can be calculated by first calculating the weights of the ions in each of the dispersing agent(s) and the electrolyte agent(s), adding said weight(s), and then dividing the total ion weight by the weight of the dry coal.

By way of illustration, in one example 0.75 grams of sodium hydroxide and 0.75 grams of sodium decyl benzene sulfonate were added to a slurry comprised of 100 grams of dry coal. The weight of the sodium ion provided by the caustic was equal to $22/40\times0.75$ grams; and it equals 0.4125 grams. The weight of the sodium ion provided by the sodium decyl benzene sulfonate was equal $22/294\times0.75$ grams; and it equals 0.0561 grams. The total weight of the sodium ion provided by both the caustic electrolyte and the sulfonate dispersing agent was 0.4686 grams. Thus, the slurry contained 0.468 weight percent of sodium ion.

When water is added to a powder comprised of finely divided particles, and if the water "wets" the powder, a surface water film is adsorbed on each particle which is known to be structurally different from the surrounding "free" or bulk water, in that the film may be described as "semi-rigid", or "bound water film". Depending on the fundamental electrical potential of the surface, this "semi-rigid" or bound water film may be of several molecules thickness. For example, on clays, the film has been estimated to be about 80° angstroms thick. Both the thickness and the structure of the bound surface water film on the particle (hence its rigidity or non-mobility) can be influenced by both anionic and cationic additions to the system, depending on the polarity of the charge at the surface of the coal particle. Adding anions and cations to a dispersion of particles also changes the net residual electrical potential (or zeta potential) at the bound (or surface) water film-free water interface. This zeta potential, when maximized by counterions formed by ion exchange reactions between surface groups (such as acid groups and salt-like bonds on the surface of the coal particles) and a counterion-providing-electrolyte dellocculates the particles, and, when neutralized by other electrolytes, it allows flocculation of the particles by London-Vander Waals forces.

Coal, by its natural chemistry, may be expected to by hydrophobic (nonwetting), but, due probably to its partial oxidation, is sometimes hydrophilic.

In practice of the invention, it is preferred also that addition of any electrolytes and/or surfactants or other dispersing agents be carried out as grinding mill additives during preparation of the coal compact, for two reasons.

In the first place, the agents maintain a low slurry viscosity during grinding. In the second place, the agents are immediately available for adsorption on the new surfaces generated during comminution of the coal. Accordingly, need for later treatment with chemical ion species on the surfaces is minimized or eliminated, thereby saving time, energy, and materials cost.

It is preferred that, in order to maximize solids content of a coal-water slurry while retaining yield pseudoplastic rheology, all parts (including, broadly, a coarse fraction and a fine fraction) of the particle size distribution of a coal compact should be controlled to provide a substantially non-undulating particle size distribution.

In some cases, depending on the coal and its inherent properties, the desired $D_L$, $D_S$ and particle size distribution may be obtained directly by milling the coal, preferably in the presence of a predetermined amount of electrolyte and/or dispersing agent(s), until tests of the grind show that the desired sizes and distribution have been obtained. This is done, for example, as follows:

The particle size distribution or consist, of particles in a sample of the compact from a mill grind of coal particles having a desired $D_L$ is determined at grinding intervals for the whole range of particles, preferably in microns. A CPFT plot vs log of particle sizes in $\mu$m is then charted in a line plot on a log-log chart. The CPFT chart line then is compared to a selected formula CPFT chart line having an n value preferably in the range of 0.2 to 0.5.

When the test results from the sample show that the desired particle size range and the particle size distribution have been obtained in accordance with the preferred CPFT consist formula, then the mill can be stopped and the coal compact used directly in the preparation of the coal-water slurry by adding carrier water to a desired concentration.

In one preferred embodiment, the value of n of the CPFT chart line should be about 0.40 to provide a coal compact having a consist of 99% minus 300 $\mu$m (50 mesh), having a $D_S$ of about 0.3 μm and having about 11 weight percent of coal particles of minus 3 micron size.

In general, the coarser the coarse end of the consist of a grind, the more fines which are required to optimize fluid properties. Conversely, the finer the coarse end of the consist of a grind, the fewer the fines which are required. Stated another way, a "coarser" compact requires a very wide particle size distribution. A "finer" compact, e.g. all passing 400 mesh, requires a narrower distribution, ($D_L$=μm).

Pulverized coal (P.C.) as usually commercially ground may be found to form a coal compact with a particle size range which is close to a particular $D_L$ and $D_S$ desired for preparing a coal-water slurry of the invention. However, the coal particle size distribution of the P.C. may not have the sufficient amount of colloidal size particles nor the substantially non-undulating particle size distribution of coal particles required for practice of this invention. In such case, it is necessary to further grind the pulverized coal until the sufficient amount of colloidal particles, i.e. at least 5 wgt. %, dry basis, are present, and a consist is obtained in accordance with the consist formula.

Also, it has been found that such a pulverized coal often can be blended as a coarse fraction with a fines fraction which has a large amount of minus 3 μm particles to prepare a coal compact provided that the blend approximates the desired distribution. At least 5 wgt. % of all the particles in the resulting blend then should be of colloidal size, usually less than 3 μm in size (SEM). The total amount of fines of colloidal, or of minus 3 μm size, in the blend can range from about 5 to 20 wgt. %, dry basis, and preferably should be about 10 wgt. %. Adding too many fines to the P.C. fraction will increase the viscosity and will reduce the value n of the CPFT chart line.

Accordingly, if a given coal cannot be ground in a single milling operation to obtain a particle size distribution conforming to the CPFT formula chart line, with its n value preferably between 0.2 and 0.5, then a blend of two or more grinds with coarser and finer particle size distributions must be made, or otherwise provided, e.g. using Black Mesa slurry waste to approximate the desired n value while also maintaining a minimum of 5 wgt. % of colloidal particles in the final blend.

Also, in some cases when, due to a peculiarity of the grinding characteristics either of a particular coal and/or of a particular milling facility, an unduly undualting particle size distribution is obtained in the coal compact from the milling facility, steps can be taken to provide coarser or finer coal particles to smooth out the particle size distribution at the undulating part or parts of the distribution, which will improve the rheological properties of the slurry.

Figure 8:
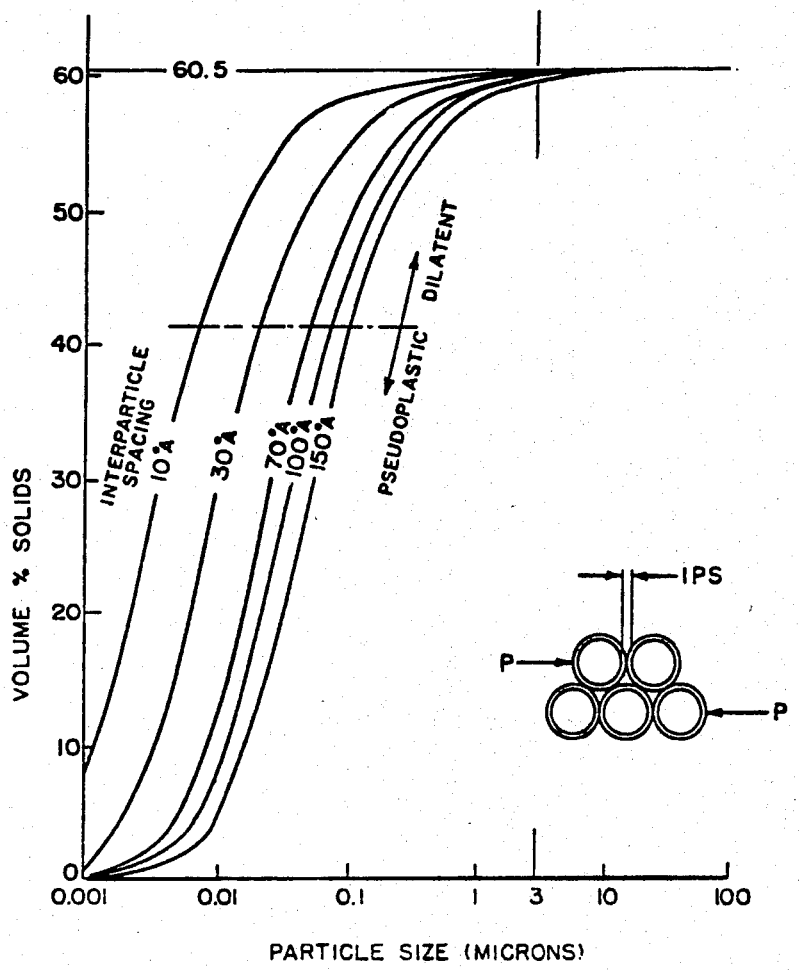
FIG. 8 is a chart illustrating effect of solids content of monospheres of solids as adsorbed bound water layer film thickness is increased and showing the significance and importance of the minus 3 μm particle fraction in the consist of a coal compact and its effect on the yield pseudoplastic properties of the coal-water slurry in which the coal compact is present.
Figure 9:
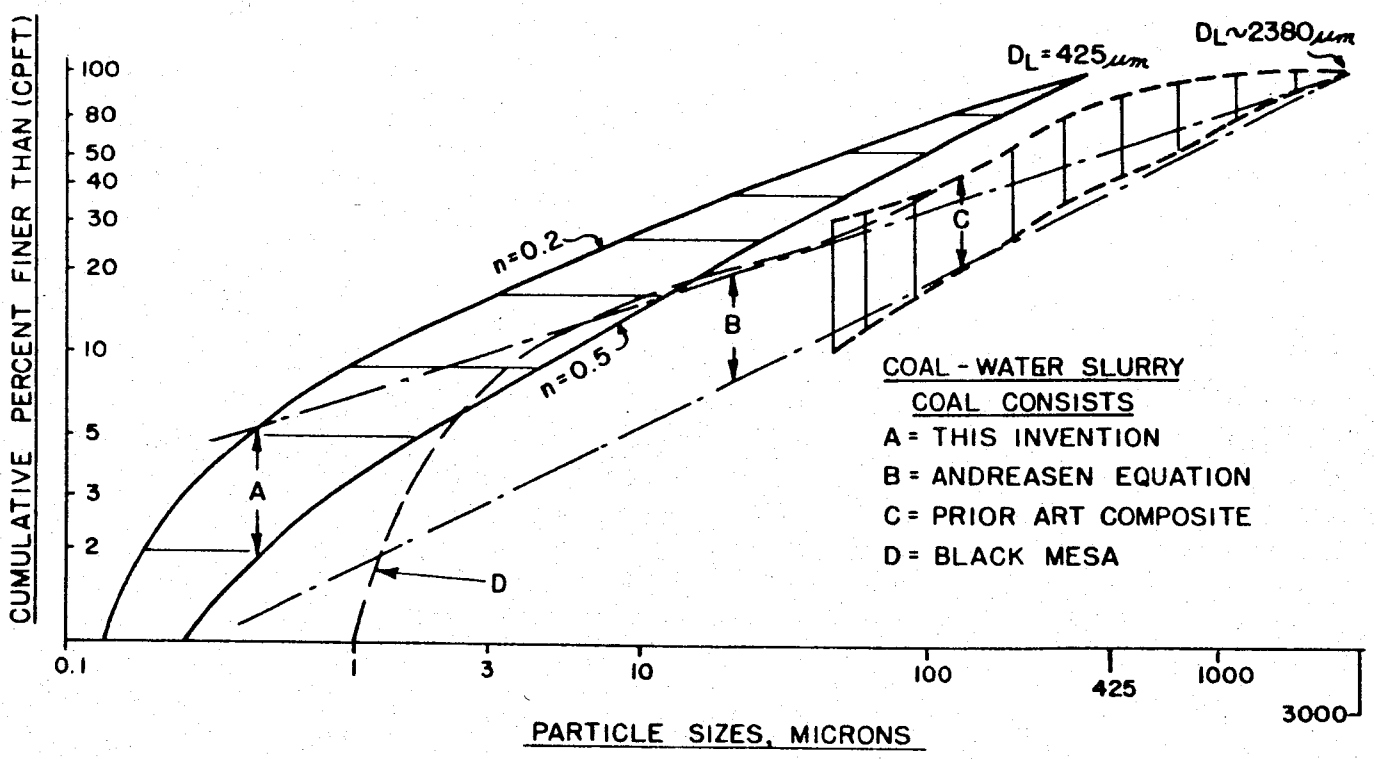
FIG. 9 is a chart showing correlations between particle size distributions (consists) by wgt. % and particle sizes in microns of: (A) typical coal compacts of this invention: (B) coal compacts having a theoretical Andreasen distribution, (C) a composite of coal compacts as determined from descriptions of coal-water slurries in prior art patents; and (D) a coal compact used in Black Mesa coal-water slurry, as described by Dina in the literature.

The significance of the colloidal, usually (—) 3 μm size, fraction with regard to pseudoplasticity and dilatency of a slurry is illustrated in FIG. 8 of the drawing. One must consider that monospheres typically pack in an average orthorhombic array at 60.51 volume % solids regardless of size with the particles touching each other.

In one preferred embodiment, the coal-water slurry of this invention is partially deashed. The term "ash", as used in this specification, includes non-carbonaceous impurities such as, e.g. inorganic sulphur, various metal sulphides, and other metal impurities as well as soil and clay particles. The fraction of ash in the cola can be calculated by dividing the weight of all of the non-carbonaceous material in th coal by the total weight of the coal. In general, in this preferred embodiment, the coal content of the pulverized coal can be enriched by use of known clay and mineral separation processes to obtain a coal of low ash content, e.g., under 5wgt. %. However, the ash content of the coal may be higher or lower than 5 wgt. %, e.g. from 0% to 20 wgt. % while permitting the benefits of the invention to be obtained.

For a given coal and coal concentration, the deashed coal-water slurry of this invention is both less viscous and cleaner than comparable prior art coal-water slurries.

Figure 14:
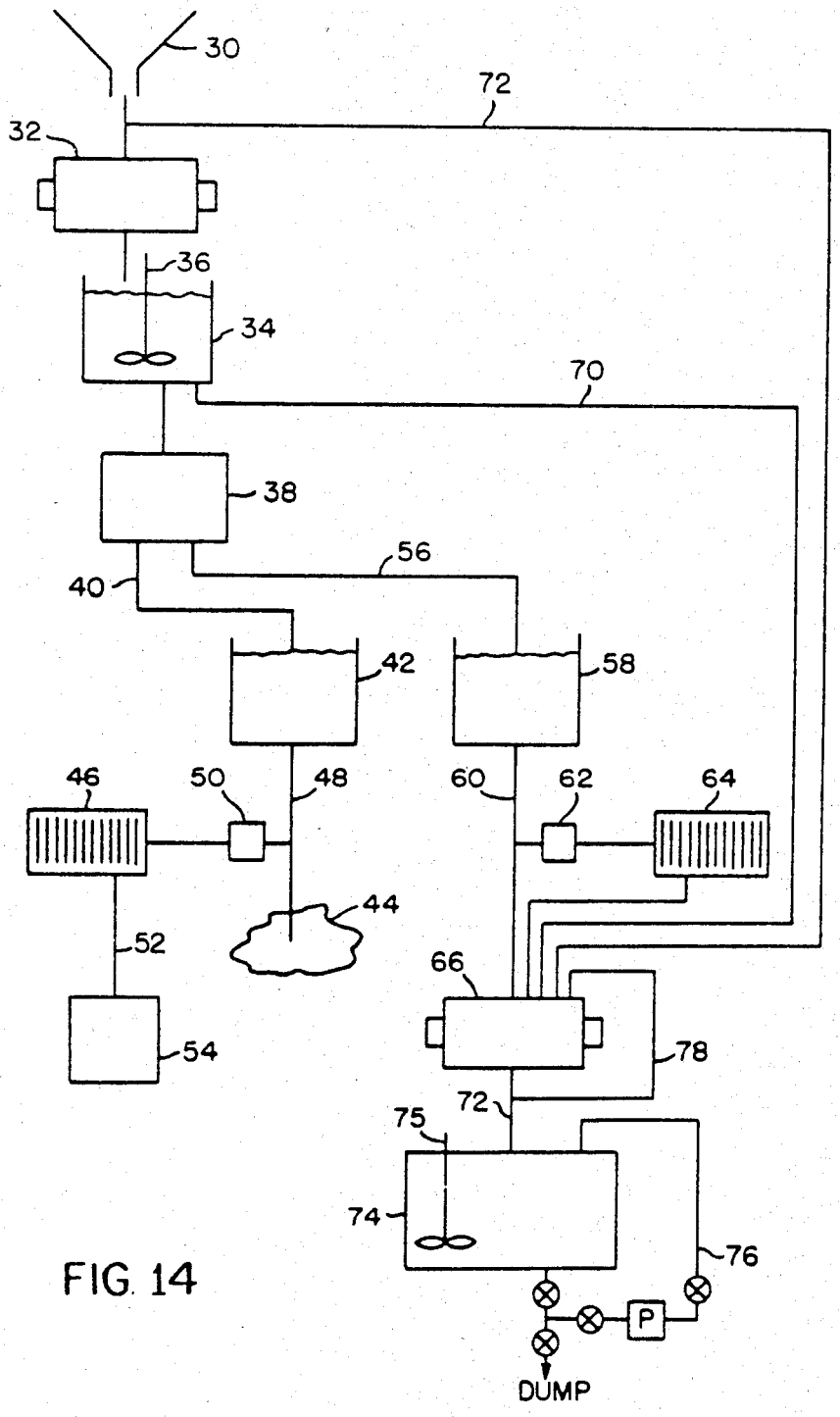
FIG. 14 is a flow diagram illustrating an integrated process for preparing a deashed coal-water slurry.

The deashed coal-water slurry of this invention can be prepared by the process illustrated in FIG. 14. The starting material for this process can be any coal, regardless of how high its ash content might be, although it is preferred that the coal used as the starting material has been chemically or mechanically cleaned by conventional techniques. In one embodiment, it is preferred that the ash content used for the starting material be less than about 20 weight percent. In a more preferred embodiment, the ash content of the starting coal material is no greater than 15 weight percent. In the most preferred embodiment, the ash content of the coal used for the starting material is no greater than 10 weight percent.

In the process of this invention, the coal used as a starting material is charged to crusher 30. Any of the crushers known to those skilled in the art to be useful for crushing coal can be used. Thus, by way of illustration and not limitation, one can use, e.g., a rod mill, a gyratory crusher, a roll crusher, a jaw crusher, a cage mill, and the like. The coal is crushed in crusher 30 to feed size appropriate to the size and type of the fine grinding mill used in the process.

The crushed coal from crusher 30 is then mixed with sufficient carrier water and ionic surfactant to produce a coal-water mixture containing from about 60 to about 85 weight percent of solids and from about 0.01 to about 2.4 weight percent based upon dry weight of coal, of surfactant and is fed to a mill 32 preferably a ball mill; in an alternative embodiment, the crushed coal, the surfactant, and the water are added separately to the mill 32 and mixed therein. In one embodiment, it is preferred to add a sufficient amount of organic or inorganic ionic surfactant so that the zeta potential of the ash particles in the coal-water slurry is from 31 15 to +15 millivolts and the zeta potential of the collidal size coal particles in the coal-water slurry is from about −100 to −15 millivolts or +15 to +100 millivolts. The crushed coal, the water, and the ionic surfactant are milled until a coal consist no greater than about 20×0 mesh is produced.

The milled coal-water-surfactant mixture is then passed to zeta potential control tank 34 which contains stirrer 36. A sufficient amount of carrier water is added to this mixture so that the solids content of the mixture is from about 10 to about 75 weight percent. If necessary, a sufficient amount of ionic surfactant is added to the mixture to adjust the zeta potential of the ash and coal particles so that the zeta potential of the ash particles is from about −15 to about +15 millivolts and the zeta potential of the colloidal coal particles is from about −100 millivolts to about −15 millivolts or from about +15 millivolts to about +100 millivolts. The surfactant added at this stage may be the same as or different from the surfactant added to ball mill 32, and from about 0.01 to about 2.4 weight percent of ionic surfactant, based upon the dry weight of the coal, can be added at this stage. It is preferred, however, that the total amount of surfactant(s) added to ball mill 32 and zeta control tank 34 not exceed about 4.0 weight percent, based upon the dry weight of the coal. Alternatively, or additionally, one may add from about 0.05 to about 2.0 weight percent, based upon dry weight of coal, soluble salts or polyvalent cations such as calcium, magnesium, iron, aluminum, and the like.

The coal-water slurry from zeta control tank 34 is then passed at least once through a coal-water slurry cleaning apparatus 38. Any of the coal-water slurry cleaning apparatuses known to those skilled in the art can be used in the process of this invention. Thus, by way of illustration and not limitation, one can use the electrophoretic deashing cell illustrated on page 3 (FIG. 3) of Miller and Baker's Bureau of Mines Report of Investigations 7960 (United States Department of the Interior, Bureau of Mines, 1974), the disclosure of which is hereby incorporated by reference into this specification. Thus, one can clean said slurry by passing it onto a sedimentation device, such as a lamella filter, where it is allowed to settle. Thus, one can effect magnetic separation of the slurry and/or combine such magnetic separation with sedimentation in the form of a pre- or post-treatment step.

The coal-water slurry from zeta control tank 34 can be cleaned by conventional cleaning processes other than electrophoretic deashing. Thus, by way of illustration, one can clean said slurry by passing said slurry onto a sedimentation device, such as a lamella filter, where it is allowed to settle. Then, one can effect magnetic separation of the slurry and/or combine such magnetic separation with sedimentation in the form of a pre- or post-treatment step.

After the coal-water slurry from zeta control tank 34 has been cleaned, it preferably contains from about 0 to 13 weight percent of ash (based on dry weight of solids in the slurry). It is more preferred that the slurry contain from about 0 to 10 weight percent of ash at this point, and it is most preferred that the slurry contain from about 0 to 5 weight percent of ash.

The ash minerals from cleaning apparatus 36 are in flocculated state and, because of this condition, can be passed by line 40 for disposal to ash and mineral sludge tank 42 and/or pond 44 and/or pressure filter 46. Waste, water and/or sludge from tank 42 can be passed by line 48 directly to pond 44 and/or all or some of said water and/or sludge can be pumped by pump 50 to pressure filter 46. Waste from pressure filter 46 can be passed by line 52 to dump 54.

The coal from cleaning apparatus 36 is in a dispersed state and, when it has been subjected to a cleaning operation such as, e.g., electrophoretic cleaning, is at a solids content of from about 10 to about 75 weight percent solids. The concentration of the solids can be raised by any combination of the three methods mentioned below.

A portion of the cleaned coal-water slurry from ash and mineral sludge tank 42 can be passed by line 56 to coal-water slurry tank 58. The cleaned coal-water mixture in tank 58 can be flocculated by, e.g., adding a nonionic organic surfactant to the mixture, by reducing, the pH of the mixture until flocculation occurs, by adding inorganic acid or inorganic acid salts as flocculating agents, or by other means well known to those skilled in the art. The flocculated coal obtained can be passed through line 60 and pump 62 to pressure filter press 64 to yield a cake with about 70 weight percent of solids. This cake can then be blended in ball mill 66 with a fraction of the deashed coal-water slurry from cleaning apparatus 34 through line 66 and/or the cake can be blended with a minor amount of relatively dry coal from crusher 30 which is passed through 72 to ball mill 66. Sufficient amount of said cake and/or said deashed coal-water slurry from cleaning apparatus 34, and/or said crushed coal from crusher 30 and whatever additional carrier water and dispersing agent may be necessary, if any, are added to ball mill 66 so that the coal-water mixture to ground contains from about 60 to about 85 weight percent of solids, from about 0.01 to about 4.0 weight percent, based on dry weight of coal, of dispersing agent, and from about 15 to about 35 weight percent of carrier water. This coal-water slurry is then ground in ball mill 66 until it has a particle size distribution substantially in accordance with the CPFT formula described in this specification.

The coal-water slurry produced in ball mill 66 can be passed by line 72 to storage tank 74. Successive charges of the slurry are blended continuously in tank 74, preferably by pumping it continuously through a recycle pipeline 76 leading from the bottom of tank 74 to the top of tank 64 or by an agitator 75. Uniformity of the slurry is thus maintained.

A portion of the coal-water slurry may be recirculated through recycle line 78 from the bottom of ball mill 66 to the top of ball mill 66 to help control the particle size distribution in ball mill 66.

Figures 15, 16:
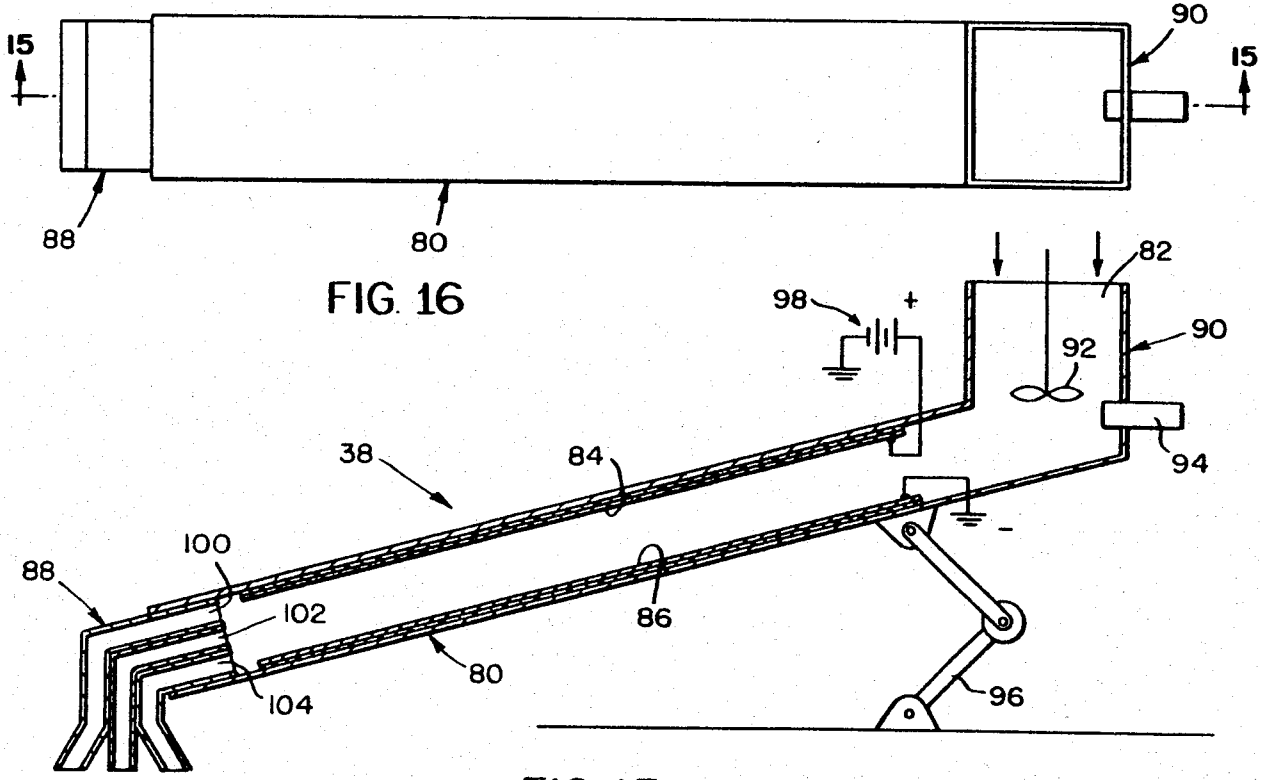
FIG. 15 is a perspective view of an electrophoretic cleaning cell which can be used to deash the coal-water slurry of this invention.
FIG. 16 is a plan view of said cleaning cell.

FIG. 15 shows one preferred embodiment of an electrophoretic de-ashing cell 38 that can be used in the present invention. However, as noted above, any conventional de-ashing cell can alternatively be used. The cell 38 includes a conduit 80 enclosing a passageway 82, a pair of electrodes 84 and 86, and a splitter 88 at the downstream end of the conduit 80. The cell 38 also includes a hopper 90 at the upstream end of the conduit with a stirrer 92 to mix the coal-water slurry charged to the hopper and with a pressure pulse generator 94 to assist in the counterflow of coal and ash mineral particles. Legs 96 may be used to raise or lower the conduit 80 to allow gravity to vary the flow rate and residence time between the electrodes.

The electrodes are preferably flat plate electrodes, preferably insulated from the conduit 80, which can be made of any suitable material, and preferably electrically insulating material. A voltage source 98 is connected across the electrodes to create a substantially vertically oriented electric field through the passageway and any slurry therein. Preferably the voltage source is a D.C. source with the top electrode 84 connected to the positive terminal and the bottom electrode 86 connected to the negative terminal. Both the coal and mineral particles are attracted to the positive terminal when both are negatively charged; however, only the coal particles rise because gravity exerts a larger force on the flocculated higher-density minerals causing them to fall toward the bottom of the passageway even against the influence of the electric field.

In another embodiment, the ash mineral particles are charged to from about 0 to about +15 millivolts, and the coal particles are charged to from about −15 to −85 millivolts. In this embodiment, the ash minerals are attracted to bottom electrode 86 and repelled by top electrode 84 thereby assisting gravity in the separation of the coal and the ash particles.

The splitter 88, as shown, preferably includes three separate discharge openings including upper opening 100 for coal and water, intermediate opening 102 for water and lower opening 104 for minerals (ash) and water. The intermediate opening 102 can be omitted, if desired. The voltage can be varied by any suitable means depending on the type and viscosity of the slurry, the slope of the conduit, and the speed of the flow therethrough, and in response to the quality of the de-ashing achieved with the previous voltage differential.

A typical voltage difference between the two electrodes is preferably in the range of from about 5 volts to about 100 volts. The distance between the electrodes is preferably in the range of from about 2 to about 4 centimeters. The flow is preferably in the range of from about 0.1 to about 10 centimeters per second, and most preferably from about 0.1 to about 3 centimeters per second.

In one aspect of this invention, a coal-water slurry comprised of from about 65 to about 85 weight percent of solids is ground until a slurry comprised of at least 5 weight percent of colloidal coal (by weight of slurry) is produced. Applicant has discovered that, when this grinding step is followed by a cleaning step, a deashed coal which is cleaned and/or less viscous for any given coal and coal concentration is produced. The fact that a less viscous product is produced is unexpected, for one might expect that a coal with more collodial particles (and hence more surface area) should be more viscous than a coal without as many colloidal coal particles.

In this invention, a coal-water slurry comprised of from about 65 to about 85 weight percent of coal, from about 15 to about 35 weight percent of carrier water, and from about 0.01 to about 2.4 weight percent of dispersing agent is ground until at least about 5 weight percent of colloidal coal particles are present: generally, in order to obtain the correct concentration of the colloidal coal fraction, one must grind the slurry until at least about 95 weight percent of the coal in the mixture has a particle size of less than 300 microns.

The slurry may be ground in a one-stage grinding operation until the particle size distribution of the coal compact in the slurry is in substantial accordance with the aforementioned CPFT formula. Alternatively, one may grind a first coal-water slurry until e.g., it is comprised of at least 10 weight percent of colloidal coal particles and thereafter blend in one or more additional fractions of either coal and/or coal-water slurries in amount sufficient to produce a coal compact in slurry which is in substantial accordance with the CPFT formula. In yet another embodiment, one or more additional fractions of coal-water slurry and/or coal are added to the finely ground coal-water slurry, and the mixture is then ground at a solids content of from about 65 to about 85 percent solids until a coal compact in substantial accordance with said formula is produced. In any event, regardless of whether one only lends the additional fractions with the finely ground coal-water slurry or blends said fractions with the finely ground coal-water slurry and then again grinds the resulting mixture, sufficient water and dispersing agent must be added to the mixture, if required, to bring its final concentation to a solids content of 65 to 85 weight percent, a water content of 15 to 35 weight percent and a dispersing agent content of from about 0.05 to about 4.0 percent. These components are preferably added, if needed, before the final blending and/or grinding step.

In one of the embodiments of this invention, the charges of the ash particles and the coal particles in the slurry are modified before the slurry is cleaned. In this embodiment, different charges can be imparted to the ash and coal particles by various means. Thus, one can add two or more chemicals to the system, each of which have different affinities for and/or different effects upon the charge of the ash and coal particles; one might, e.g., add one ionic surfactant for the ash particles and a separate ionic surfactant for the coal particles. Thus, one can use purely electrical charging means well known to those in the art to impart the different charge. Thus, e.g., one can add one chemical to the system which, becwuse of the different chemical and physical properties of the coal and ash particles, will have different effects upon the charges of said particles.

In one preferred embodiment, an ionic dispersant which has the capability of charging the carbonaceous and non-carbonaceous materials to the specified zeta potentials is utilized. In another preferred embodiment, two or more ionic dispersants, each of which selectively charges either the carbonaceous coal particles and/or the ash particles to the specified levels, are utilized.

The kind of water used as carrier water in the coal-water slurry of this invention may be any available water, such as mine, well, river, or lake water or desalinated ocean water having a sufficiently low mineral salt content such that the electrochemistry of the bound water layer and carrier water interface can be controlled in accordance with the invention and corrosion of milling facilities, pipelines and furnaces will be minimized and controllable.

The kind of coal used for practices of the invention is not critical. Coals found in the United States, particularly low volatile bituminous coals, from West Virginia, high volatile bituminous from Kentucky, Ohio, Arizona or sub-bituminous Montana fields, have been used. However, anthracite, semi-anthracite, medium and high-volatile bituminous, sub-bituminous and lignite coals all may advantageously be used to practice the invention.

As used in this specification, the term "carrier water" means the bulk or free water dispersed between the coal particles and contiguous to the bound water layers on the particles.

In the consist used in the coal-water slurry of this invention, the value of n is dependent on the sizes of $D_L$ and $D_S$. The size of $D_L$ for a particular coal is a fully controllable function of the grinding operation. It can be controlled by grinding coal until a desired size of $D_L$ is obtained. The size of $D_S$ is a less controllable function. It is dependent on the grindability of a particular coal, and will usually be the same $D_S$ size for that coal ground in the same mill.

The coal for use in the process can be obtained in a dry or wet form and mixed with water to form a coal-water slurry. Preferably, the coal for making a fine particle sized fraction is wet milled in known ways to prevent dust and explosion hazards, while adding dispersing agent(s) to the water in accordance with this invention. The wet milled coal fraction can be milled with all the water or it can be mixed with sufficient additional water to make a slurry which will be readily pumpable in a pipeline, when it further is mixed with a coarser particle sized pulverized coal fraction to form a coal-water slurry according to the invention.

In another embodiment of this invention, a process for pumping the coal-water slurry of this invention is provided wherein the viscosity of the slurry being pumped decreases at constant shear rate with time, at increasing shear rate, and at increasing temperature. In this embodiment, the coal-water slurry of this invention is maintained at a temperature of from about 20° to about 90° Centigrade while it is being pumped. It is preferred to maintain the slurry at a temperature of from about 35 to 80degrees Centigrade during pumping. and it is even more preferred to maintain the slurry at a temperature of from about 40 to about 80 degrees Centigrade during pumping. When the slurry is being pumped for pipeline transport, the shear rate of the slurry should be from about 20 to about 200 sec.$^{-1}$. When the slurry is being pumped from atomization, the shear rate should be from about 50 to about 50,000 sec.$^{-1}$.

The following examples are presented to illustrate the claimed invention but are not to be deemed limitative thereof. Unless otherwise stated, all parts are by weight and all temperatures are in degrees centigrade.

EXAMPLE 1—PROCEDURE FOR SCREENING AND SELECTING DISPERSING AGENTS FOR USE IN MAKING ALFRED FORMULA COAL WATER SLURRY.

A surfactant or combination of surfactants effective for use in practicing the invention may be found by either of the two following methods (a) or (b) as applied in (c).

(a) Zeta potential measurement.

In general, a sample of coal is ground in a laboratory size porcelain ball mill with porcelain balls in water at 30 wgt. % solids for approximately 24 hours to insure that all the particles are $<10\ \mu m$. Small samples of this larger sample are then prepared in a known way by placing them in a vessel equipped with a stirrer with a sample of water to be used as a carrier in the Alfred formula coal-water slurry. Various acidic and basic salts are then added in incremental amounts to vary the pH, and various concentrations of various candidate dispersing agent organic surfactants likewise are added in incremental amounts (e.g. grams per gram coal, both dry basis), alone or in combinations of two or more. These samples are then evaluated in any electrophoretic mobility, electrosomosis, or streaming potential apparatus to measure electrical potentials, from which the zeta potential is calculated in a known way. Plots of zeta potential vs pH vs. concentration may then be made to indicate canidate surfactants, or combinations thereof to be used to produce the optimum dispersion of coal particles in the carrier water below the amount at which dilatency may be reached. A Pen Kem System 3000 apparatus was used in the determination described and can process 40 samples in about 6 hours.

(b) Alternate method for estimating equivalent zeta potential.

A large sample of coal is ground in water as described in (a) above at 50 wgt. % solids for about 2 to 4 hours to produce a slurry. This slurry is found to have a Brookfield viscosity at 30 rpm of about 10,000 cps.

Smaller samples, about 500 ml, of this slurry are the deflocculated by adding various candidate dispersing agent surfactants and surfactant combinations to the sample of slurry, as above, dry or, preferably, in solution, dropwise, blending gently, and then measuring the viscosity at some constant shear rate (e.g., using a Brookfield LVT viscometer at 30 rpm). A surfactant system which is found to produce an acceptably low, preferably the lowest, viscosity at the lowest amount, e.g. in wgt. % of addition on a dry coal basis is thereby identified as the most effective surfactant.

(c) Reference may now be made to FIGS. 2 and 13, which summarize the results obtained in screening tests carried out in accordance with (a) and (b) of this example using coal from an Eastern Kentucky mine at 55 wgt. % concentration and an anionic organic surfactant, sodium salt of an alkyl mononapthalene sulfonic acid (Lomar D), as a deflocculant dispersing agent.

Referring to FIG. 13, and its inset, it is seen that as the amount of deflocculant was increased from zero to 0.945 wgt. %, the zeta potential increased gradually with each incremental addition of Lomar D from (−) 15.4 mv at 0.079 wgt. % to (−) 70.2 mv at 0.945%. Simultaneously, as the shear rate (rpm) was increased during the time of presence of each incremental amount, the Brookfield viscosity is seen to decrease until it reaches a minimum value at 30 rpm, while the rheology of the system is seen to change from pseudoplastic to dilatent at a rate between 30 and 60 rpm.

Referring now to FIG. 2, it is seen that the chart line formed from the data from the inset of FIG. 13 forms a distinctive curve. The curve shows that as zeta potential increases from (−) 15.4 to (−) 67.7 mv, the Brookfield viscosity falls from about 7000 cps to about 80 cps and then levels off at about 75 cps at (−) 70.2 mv. From this data and chart, it is indicated that near maximum zeta potential can be identified as being about (−) 63.2 $\mu m$, and the amount of Lomar D to use to make an Alfred formula coal-water slurry will be about 0.5 wgt. % based on the weight of coal, both dry basis. To be on the safer side, the amount of dispersing agent can be decreased slightly, e.g. to about 0.45 wgt. %, or less.

While the above methods have been described using a preferred dispersing agent, Lomar D, it will be clear to one skilled in the art that any material can be similarly screened to find advantageous materials which can be used to practice the invention.

EXAMPLE 2—PREPARATION OF COAL SAMPLES FOR SIZE MEASUREMENTS.

(a) Sieve analysis.

Although any standard procedure may be used to measure particle sizes of coal particles from a coal and then to calculate the particle size distribution the procedure used in obtaining data discussed herein will be described.

A weighed sample, e.g. 50 grams dry wgt. of coal is dispersed in 400 ml of carrier water containing 1.0 wgt. % Lomar D based on a weight of coal, dry basis, and the slurry is mixed for 10 minutes with a Hamilton Beach mixer. The sample is then allowed to stand quiescent for 4 hours, or preferably, overnight. (This step usually is not necessary if the slurry was milled with surfactant).

The sample is then remixed very briefly. It then is poured slowly on a stack of tared U.S. Standard sieves over a large vessel. The sample is carefully washed with running water through the top sieve with the rest of the stack intact until all sievable material on that sieve is washed through the sieve into the underlying sieves. The top sieve is then removed and each sieve in the stack, as it becomes the top sieve, is successively washed and removed until each sieve has been washed. The sieves are then dried in a dryer at 105° C. and the residue on each is weighed in a known way.

The sample which passed through the finest sieve was collected as a dilute slurry in a container for Sedigraph analysis.

(b) Sedigraph analysis.

The sample finer than the smallest sieve size is carefully stirred and a representative sample (about 200 ml) is taken for analysis. The rest may be discarded.

About 2 eyedroppers of the dilute slurry is further diluted in 30 ml of distilled water with 4 drops of Lomar D added. This sample is stirred overnight with the magnetic stirrer. Measurement is then made with the Sedigraph 5500L.

The Sedigraph 5500L uses photo extinction to measure particles. It essentially measures projected shadows and due to diffraction effects around particles the data must be converted to mass-wgt.-%-finer-than. The data from the sieve and Sedigraph is combined with the $D_S$ data obtained by SEM and used to prepare a CPFT chart.

EXAMPLE 3—PREPARATION OF BIMODAL BLENDED 75 WGT. % COAL WATER SLURRY, $D_L$=150 um

A 75 wgt. % coal-water slurry hereof is prepared using coal from the Black Mesa mine, as follows. A fine (F.G.) grind portion is prepared by adding to a ball mill 30 parts of carrier water, about 22.5 parts of pulverized coal (P.C.) and further adding, an electrolyte and dispersing agents, 0.075 parts of anionic surfactant, preferably Lomar D, and 0.075 parts of NaOH. The mixture is ball milled until the particle size distribution is about 45 wgt. % finer than 3 μm. Also, about 52.5 parts of dry pulverized coal (P.C.) are milled until the coal has a particle size distribution in accordance with the Alfred consist formula where $D_L$ is 150 μm (100 mesh), $D_S$ is <0.7 μm, and n is 0.8, as defined above, to obtain a pulverized coal (P.C.) fraction which is about 78 wgt. % (−) 79 μm. A sufficient amount (47.35 parts) of the P.C. fraction is then added to the fine grind coal fraction to form the final 75 wgt. % coal-water slurry having an Alfred formula consist of 150 μm×0.2 μm with about 17.5 wgt. % minus 3 μm. The total amount of electrolyte and dispersing agent(s) used is predetermined by laboratory tests as described herein. It is effective to bring the entire compact of pulverized coal particles to near maximum zeta potential, and also, to maintain the particles in dispersed, or deflocculated. form in the carrier water of the slurry during pipeline pumping storage and pumping to an atomizer of a coal-water slurry burner or to other use means.

The above method can easily be carried out whether using monomodal or multimodal distributions of particle sizes. For a monomodal distribution the electrolyte and dispersing agent preferably are added to the carrier water before it enters the pulverizing mill with the coal. The coal is then ground in the presence of these agents. For multimodal distributions the deflocculant dispersing agent preferably is added in water as described above, while grinding the fine fraction, and no dispersing agent needs to be added to the coarse pulverized (P.C.) fractions. the coarse dry P.C. fraction can then be added to the deflocculated F.G. fraction, as described above.

If a coal cleaning process including use of a filter press to recover solids is incorporated in the process, coarse P.C. grind having a coarse fraction consist suitable for preparing Alfred formula compact is first cleaned, then flocculated using appropriate flocculating chemicals prior to filter pressing and dewatering the coal, which removes these chemicals. An appropriate percentage of P.C. filter cake is then fine ground in the presence of all the deflocculant added as required to prepare the F.C. fraction. The resulting fine ground deflocculated slurry is then blended with an appropriate percentage of the P.C. filter cake in a fine blunger or mixing tank to obtain Alfred formula coal-water slurry ready for pipeline pumping or storage or for burning or otherwise using the coal-water slurry.

EXAMPLE 4—INTEGRATED PROCESS WITH DEASHING AND BLENDING $D_L$=300 μm.

The practice of the invention in an integrated process for plant scale operation with de-ashing of West Virginia coal will now be described with reference to FIGS. 6 and 7 of the drawing.

Figure 11:
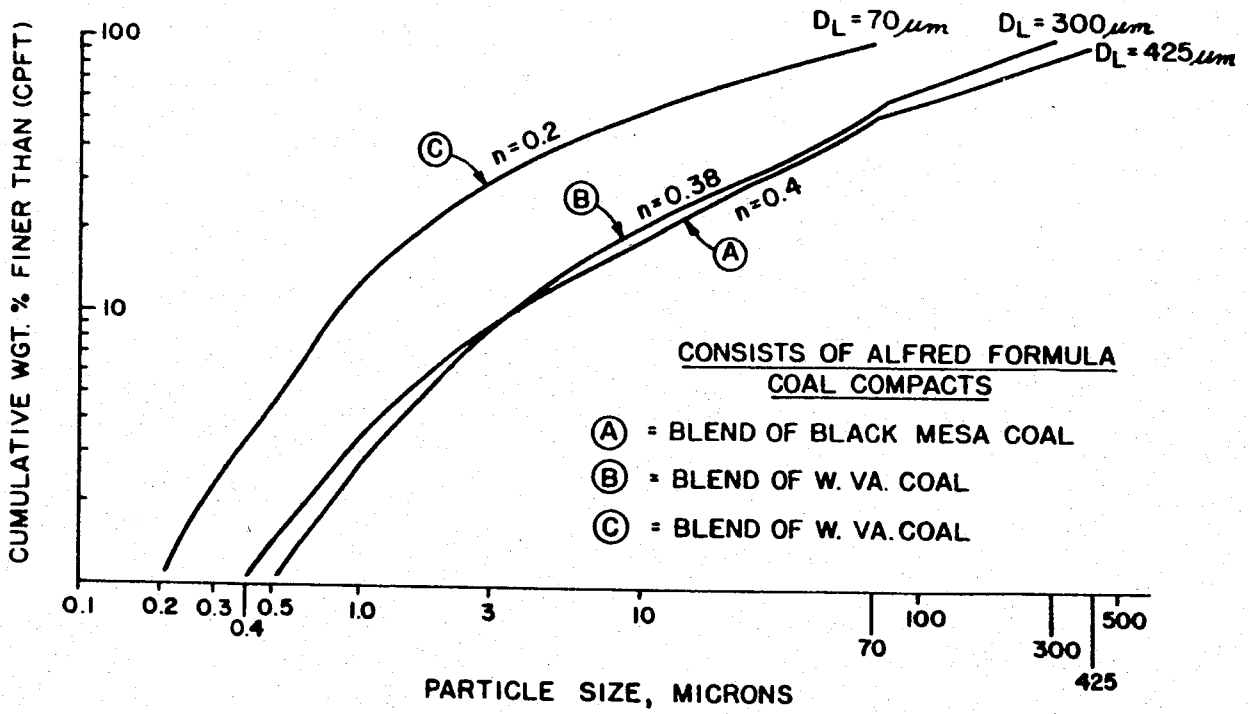
FIG. 11 is a chart showing correlations between consists by wgt. % and particle size in microns of coal compacts made according to the consist formula from blends of coarse and fine fractions of Black Mesa coal and of West Virginia coal, respectively, with $D_L$ as shown and with $D_S<3$ μm.

Bituminous coal from West Virginia, containing about 21% ash as mined or washed is introduced into a crusher 1 wherein it is crushed to about 2" size or less. The term "Ash" is used herein to define non-combustible content of the coal, such as clay and various minerals. The crushed coal is charged into a mill 2, preferably a ball mill, where it is wet milled to a particle size of about 70%(−)200 mesh ((−)75 μm) with about 7% (−)3 μm to provide a coarse fraction of coal particles suitable for preparing a coal compact in accordance with the Alfred consist formula with $D_L$=300 μm, $D_S$=<1.0 μm and n=0.5, substantially as shown in FIG. 11, when mixed with the fine grind portion made as described later herein.

The particles of coarse milled coal are then charged to a slurry tank 3 containing carrier water in an amount sufficient to maintain a solids content of about 10% by weight. The pH of the mass in tank 3 is maintained at a pH of 10 or higher by addition of a solution of NaOH to cause deflocculation and separation of ash materials. Tank 3 is provided with a high intensity agitator 4 to effect dispersion of all particles. After about 20 minutes agitation, the slurry is continuously pumped by pump 3*a* through line 7 through the hydrocyclone 5 and hence back to tank 3. The hydrocyclone 5 removes the higher specific gravity minerals, preferably flocculated, and delivers them to scrap or reprocessing. After a suitable time of cycling the slurry through the hydrocyclone to maximize ash removal, the valve 3B is closed and valve 3C opened to filter press 6 to filter the batch from tank 3. Filtrate from filter press 6 is recycled to tank 3. The pH of the water is adjusted by addition of a solution of caustic soda (NaOH). The partially ash-free coal thus obtained contains from about 0.5 to 10 wgt. % of ash. Treatment of the coal in tank 3 is, however, beneficial to remove at least gross amounts of the ash content of the coal, thereby increasing the net btu value of the coal-water slurry.

A minor fraction of the filter cake from filter 6 containing filtered coal and about 25 wgt. % water is discharged to a second slurry tank 8 where the cake may be diluted with water from line 8*a*, if water is needed and is agitated by means of a low speed agitator 9*a* operated as in tank 3. The filter cake is dispersed in tank 8 with sufficient water present to later make a final coal-water slurry of about 75 wgt. % solids after adding a first predetermined amount of deflocculant, further milling this minor fraction of coal to a fine grind and blending it with a major fraction of filtered coal from filter press 6 in a third slurry tank 14. The coal-water slurry from tank 8 is discharged through line 15 into line 16 from which it is fed into lines 17 and 18 leading to ball mills 19 and 20. A final predetermined amount of a solution of mixed deflocculants, usually making a total amount providing about 0.7 wgt. % of Lomar D and 0.7 wgt. % of NaOH and usually sufficient to adjust the zeta potential of the particles to near maximum zeta potential and to disperse the particles, based on the total amount of dry coal in the final coal-water slurry to be made in tank 14, is added to the coal-water slurries in ball mills 19 and 20. The ball mills preferably are steel and are loaded with steel balls. The coal is milled to a fine grind about 95 wgt. % (−) 40 μm × about 10 wgt. % (−) 3 μm. The milled, fine grind coal is discharged from ball mills 19 and 20 through lines 24 and 25 into tank 14 where it is blended and agitated by means of agitator 9 with the major fraction of de-ashed coal from filter press 6. The coarse and fine grind coals are blended in proportions such that the blend has 75 wgt. % of coal, dry basis, and the coal particles have a substantially non-undulating Alfred formula coal consist having about 10 wgt. % of coal particles (−) 3 μm and the particles have a particle size range of about 300 μm × 0.1 μm. The resulting final coal-water slurry product is a pipeline pumpable 75 wgt. % low viscosity Alfred formula coal-water slurry usually having a brookfield viscosity of about 1000 to 2000 cps at 60 rpms.

The deflocculated yield pseudoplastic coal-water slurry is discharged from tank 14 to a storage tank 10. Successive charges of the slurry are blended continuously in tank 10, peferably by pumping it continuously through a recycle pipeline 11 leading from the bottom of tank 10 to the top of tank 10. Uniformity of the slurry is thus maintained and provides slurry of a sustantially uniform btu content. The blended Alfred formula coal-water slurry is pumped from storage tank 10 through pipeline 27, which may be a short pipeline or a long distance pipeline, and is fed into an atomizer burner 12 of a furnace 13 used to generate heat energy to heat water in a steam boiler. Details of a typical atomizer burner for burning a coal-water-anionic organic surfactant are shown in FIG. 7.

Aqueous treatment of the coal for ash removal, deflocculation, and concentration also provides a suitable vehicle for sulfur removal. The amount of deflocculant or of a mixture of deflocculants, such as the anionic organic surfactant and NaOH, which must be used to obtain the benefits and advantages of the invention using the Alfred formula consist can be readily predetermined in accordance with the procedures described in Examples 1–3.

EXAMPLE 5 OF INTEGRATED PROCESS, WITH BLENDING BUT WITHOUT DEASHING, $D_L$=400 μm

Practice of the invention in an integrated process without deashing for plant scale operation with Black Mesa, Arizona, coal will now be described with further reference to FIGS. 6 and 7 of the drawing.

Sub-bituminous coal from Black Mesa coal fields containing an average ash content of 9.8 wgt. % (range of 6.5% to 17%) as mined or washed is introduced into crusher 1 and crushed to 2" size or less. The crushed coal is milled in about 10 wgt. % of carrier water to prepare pulverized coal (P.C.) particles 50 to 70 wgt. % substantially all finer than 400 μm and suitable for preparing a coal consist in accordance with the Alfred formula with $D_L$=400 μm, $D_S$=<1.0, and n = about 0.45, when mixed with the fine milled portion made as described later herein. The P.C. coal is discharged from mill 2 through line 16. Because of the low ash content of Black Mesa coal, kit usually will not be necessary or desirable to de-ash the coal.

A minor fraction of the milled (P.C.) coal from line 16 is fed through lines 17 and 18 into ball mills 19 and 20. A solution of part of a predetermined amount of deflocculant materials is added to ball mills 19 and 20 and additional carrier water is added to each mill, for example, from line 8a, through tank 8, line 15 and lines 17 and 18, respectively. The amount of water added will depend on the amount of water present in the pulverized coal from ball mill 2. A major fraction of pulverized coal is fed through lines 16, 17, 18, 25 and 26 to tank 14. The total amount of minor and major fractions of pulverized coal will amount to a final amount of coal which when diluted with the water added to ball mills 19 and 20 will make up to a 75 wgt. % coal-water slurry and can readily be calculated. The rest of the predetermined amount of deflocculants needed to provide the colloidal particles of coal in the coal-water slurry with near maximum zeta potential is added to the ball mills 19 and 20 to provide a mixture of 1.0 wgt. % of Strodex V8 and 1.0 wgt. % NaOH, based on the total weight of dry coal in the final coal-water slurry to be made up in tank 14. The necessary amount of water needed in mills 19 and 20 is added also. The mills are run for about 30 hours at 60 rpm or until a fine grind of Black Mesa coal is obtained which is 99 wgt. % minus 10 μm and about 46 wgt. % minus 3 μm. The milled, fine grind coal-water slurry is then discharged into tank 14 where it is blended with the major fraction of pulverized coal in proportions such that the blend has 75 wgt. % of coal, dry basis, and the coal particles have a substantially non-undulating coal consist in accordance with the Alfred formula as defined above with n=about 0.45 and particle size of about 7 wgt. % of coal particles minus 3 μm. The resulting Alfred formula coal-water slurry usually will have a Brookfield viscosity of about 4000 cps at 60 rpm, substantially as shown in FIG. 1, A.

The deflocculated, yield pseudoplastic 75 wgt. % coal-water slurry is discharged into tank 10, where it is blended as described in Example 4, and pumped to a use site in short or long distance pipelines for burning in an atomizer burner furnace as described in Example 4.

EXAMPLE 6—INTEGRATED PROCESS, WITH OR WITHOUT DEASHING WITH BLENDING, $D_L$=75 μm

Using substantially the same method as described in Examples 4 and 5, West Virginia or Eastern Kentucky coal, can be milled and dispersed in carrier water to prepare pipeline pumpable Alfred formula coal-water slurry with from about 65 to 77 wgt. % coal, with $D_L$=75 μm, $D_S$=<1.0 μm, and n=0.2 to 0.8 with about 6.6 to 29.3 wgt. % of particles of (−) μm. The slurry will usually have a Brookfield viscosity of 60 rpm of from 300 to 2400 cps.

EXAMPLE 7—INTEGRATED PROCESS, WITHOUT BLENDING, $D_L$=300 μm

In view of the finding that West Virginia coal can be milled directly to prepare an Alfred formula coal compact, this coal usually can be milled and used to make coal-water slurry without need to make a blend from a coarse fraction and a fine fraction as was done in Examples 4–6.

Figures 6, 7:
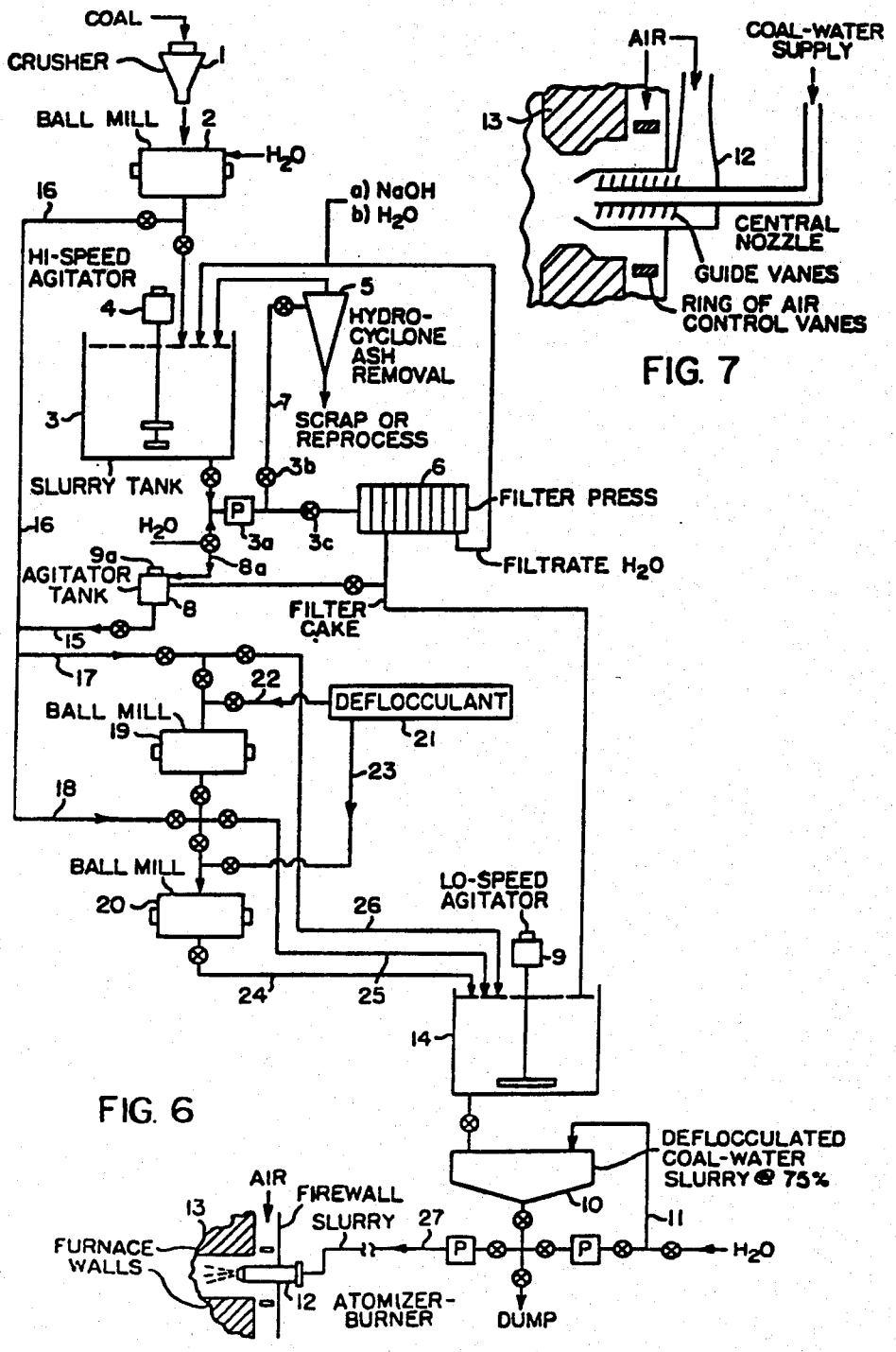
FIG. 6 is a flow diagram illustrating an integrated process for preparing a consist coal-water slurry and utilizing the slurry in a furnace.
FIG. 7 is a cross-sectional view of a typical atomizer, or turbulent flow, burner in which a consist coal-water slurry can be burned.

Referring to FIG. 6, 75 wgt. % Alfred formula coal-water slurry having an Alfred formula consist with $D_L$=300, $D_S$=<10 and n=0.2 to 0.6, substantially as shown in FIG. 12, can be made as follows:

Crushed coal is charged into mill 2 and wet milled to a particle size of about 50 wgt. % (−) 200 mesh ((−) 75 μm). The coarse grind is discharged through line 16 into ball mill 19 or 20, alternately or simultaneously, as desired. Predetermined total amounts of electrolyte and/or dispersing agent(s), e.g. 1.0 wgt. % of Lomar D and 1.0 wgt. % o NaOH, are added to each of mill 19 and/or 20 as needed from deflocculant tank 21. The coal is then milled in mills 19 and/or 20 until a sample shows that the $D_L$, $D_S$ and n values recited above have been attained and that there are at least 5 wgt. % of particles (−) 3 μm present. Usually the amount of (−) 3 μm particles will be from about 20.5 wgt. % at n=0.2 to about 5.0 wgt. % at n=0.6. The coal-water slurry is tested to confirm that the zeta potential is near maximum zeta potential (e.g. about (−) 50 mv as shown in FIG. 2), and that the Brookfield viscosity is about 1000–1500 cps. The slurry is then discharged into tank 14 for blending of batches. The slurry can be stored in tank 10 and charged from there into the atomizer burner 12 for burning.

EXAMPLE 8—INTEGRATED PROCESS, WITHOUT BLENDING, WITH DEASHING, $D_L$=300 μm

If the West Virginia coal is to be used in a deashed form, the above process can be modified by discharging the 50 wgt. % (−) 200 mesh coal from mill 2 into tank 3 for deashing substantially as described in connection with Example 4. The deashed filter cake from filter press 6 can then be charged to tank 8 for dilution with carrier water and transferred to mills 19 and/or 20 as discussed above for further milling and deflocculation to form the Alfred formula coal-water slurry having the properties as described above.

EXAMPLE 9

A coal-water mixture comprised of 78 weight percent of Upper Freeport coal, dry basis, 1.0 weight percent of Lomar D®, based on dry weight of coal, 0.2 weight percent of sodium hydroxide, and 21.5 weight percent of carrier water was ground in a 3 foot by 5 foot diameter ball mill to prepare a coal-water slurry containing 75 weight percent of solids, 17.95 weight percent of ash (by weight of total solids). The particle size distribution in the slurry was in substantial accordance with the formula:

$$CPFT = \frac{D^n - D_S^n}{D_L^n - D_S^n} \times 100$$

wherein CPFT is as described hereinabove, n is about 0.34, $D_L$ is about 250 microns and $D_S$ is about 0.2 microns. At least 99 weight percent of the coal particles in this slurry were smaller than 300 microns.

A sufficient amount of distilled water was added to this slurry to adjust the solids content to 60 weight percent. Thereafter, 13.7 microliters of a 0.04 normal calcium hydroxide aqueous solution were added to the slurry, and a sufficient amount of sodium hydroxide was thereafter added to the slurry to adjust the pH to 9.3.

The coal-water slurry was placed in an electrophoretic cell which consisted of two vertical, parallel plates, each one of which had a surface area of one square inch; the plates were placed 2.25 centimeters apart from each other. Both of the plates were in an open container at room temperature and at atmospheric pressure. A direct voltage was imposed across the plates the coal-water slurry until the current reached approximately 150 milliamperes; approximately 9.6 volts was required to reach said current flow. Elecrophoresis took place for from about 10 to about 15 minutes. A cake like film was deposited on the cathode. The coal-water slurry was then removed from the container housing the cell.

The process described in the above paragraph was repeated about 15 times with additional portions of coal-water slurry to produce more product upon the cathode. The cathode deposit was saved, and the remaining slurry was discarded.

The cathode deposit was tested for solids and ash content and was found to contain 75.08 weight percent of solids and 13.55 weight percent of ash.

The cathode deposit was combined with a sufficient amount of carrier water and sodium hydroxide to produce a coal-water slurry containing 60 weight percent of solids and having a pH of 9.3.

It is to be understood that the foregoing description and Examples are illustrative only and that changes can be made in the ingredient and their proportions and in the sequence and combinations of process steps as well as other aspects of the invention discussed without departing from the scope of the invention as defined in the following claims.

The embodiments of this invention in which an exclusive property or privilege is claimed are as follows:

1. A coal-water slurry comprised of from about 65 to about 85 weight percent of solids by weight of slurry, from about 15 to about 35 weight percent of carrier water by weight of slurry, and from about 0.01 to about 4.0 weight percent of polyelectrolyte dispersing agent by weight of dry coal in said slurry, wherein:

(a) said coal-water slurry has a Brookfield viscosity of less than 4,000 centipoise when tested at a solids content of 75 weight percent, ambient temperature, and 60 revolutions per minute;

(b) said coal-water slurry has a yield stress of from about 0.1 to about 10 Pascals;

(c) from about 5 to about 36 weight percent of the particles of coal in said slurry are of colloidal size, and being smaller than about 3 microns, and said colloidal sized particles of coal have a net zeta potential in said coal-water slurry of from about 15 to about 85 millivolts;

(d) at least about 85 weight percent of the particles of coal in said coal-water slurry have a particle size less than 300 microns; and (e) said coal-water slurry comprises a compact of finely-divided particles of coal dispersed in said carrier water; and (f) said compact of finely divided particles of coal has a particle size distribution substantially in accordance with the following formula:

$$CPFT = \frac{D^n - D_S^n}{D_L^n - D_S^n} \cdot 100,$$

CPFT is the cumulative weight percent, dry basis, of particles finer than a particle of stated size, D, D is the diameter of any particle in the compact, $D_L$ is the diameter of the largest particle in the compact, sieve size or its equivalent, being from about 38 to about 400 microns, $D_S$ is the diameter of the smallest particle in the compact, being from about 0.01 to about 0.4 microns, and n is numerical exponent, with n being from about 0.2 to about 0.5 and with all diameters sized in microns.

2. The slurry as recited in claim 1, wherein said polyelectrolyte dispersing agent is an organic polyelectrolyte dispersing agent.

3. The slurry as recited in claim 2, wherein the pH of said slurry is from about 5 to about 12.

4. The slurry as recited in claim 3, wherein said organic polyelectrolyte dispersing agent has at least two sites on each of its recurring structural units which, when said polyelectrolyte is in carrier water, provides electrical charge.

5. The slurry as recited in claim 4, wherein the pH of said slurry is from about 7 to about 11.

6. The slurry as recited in claim 5, wherein said n is from about 0.27 to about 0.42.

7. The slurry as recited in claim 6, wherein the Brookfield viscosity of said slurry when it is tested at 75 weight percent of solids, 60 revolutions per minute, and ambient temperature and pressure is from about 300 to about 2400 centipoise.

8. The slurry as recited in claim 7, wherein at least about 90 weight percent of the particles of coal in the slurry have a particle size less than about 300 microns.

9. The slurry as recited in claim 8, wherein said slurry has a yield stress of from about 0.5 to about 7 Pascals.

10. The slurry as recited in claim 9, wherein said colloidal particles of coal in said slurry have a net zeta potential of from about 30 to about 70 millivolts.

11. The slurry as recited in claim 10, wherein said two sites on each of said recurring structural units of said organic polyelectrolyte dispersing agent are independently selected from the group consisting of ionizable carboxylate, sulfonate, sulfate, and phosphate groups.

12. The slurry as recited in claim 10, wherein at least about 95 weight percent of the particles of coal in the slurry have a particle size less than about 300 microns.

13. The slurry as recited in claim 12, wherein said slurry has a yield stess of from about 0.75 to about 5 Pascals.

14. The slurry as recited in claim 13, wherein the Brookfield viscosity of said slurry when it is tested at 75 weight percent of solids, 60 revolutions per minute, and ambient temperature and pressure, is less than about 2,000 centipoise.

15. The slurry as recited in claim 14, wherein sai slurry contains less than about 5 weight percent of ash by weight of solids.

* * * * *